United States Patent [19]

Okada et al.

[11] Patent Number: 5,006,444

[45] Date of Patent: Apr. 9, 1991

[54] SILVER HALIDE PHOTOGRAPHIC MATERIAL

[75] Inventors: Hisashi Okada; Morio Yagihara, both of Kanagawa, Japan

[73] Assignee: Fuji Photo Film Co., Ltd., Kanagawa, Japan

[21] Appl. No.: 564,822

[22] Filed: Aug. 9, 1990

[30] Foreign Application Priority Data

Aug. 9, 1989 [JP] Japan ..... 1-205885

[51] Int. Cl.[5] ..... G03C 1/06

[52] U.S. Cl. ..... 430/264; 430/223; 430/598; 430/955; 430/957

[58] Field of Search ..... 430/223, 264, 598, 955, 430/957

[56] References Cited

U.S. PATENT DOCUMENTS

| | | | |
|---|---|---|---|
| 4,737,442 | 4/1988 | Yagihara et al. | 430/264 |
| 4,770,990 | 9/1988 | Nakamura et al. | 430/564 |
| 4,914,002 | 4/1990 | Inoue et al. | 430/264 |

FOREIGN PATENT DOCUMENTS

| | | | |
|---|---|---|---|
| 61-213847 | 9/1986 | Japan | 430/598 |

OTHER PUBLICATIONS

English Abstract-JP-A-61-213847, entitled "Pattern Forming Method".

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A silver halide photographic material comprising at least one compound represented by formula (I):

$$\mathrm{PUG}\text{-}(\mathrm{Time})_t\text{-}\mathrm{V}\text{-}\overset{\overset{\displaystyle R}{|}}{\mathrm{N}}\text{-}\mathrm{O}\text{-}\mathrm{X} \qquad \text{(I)}$$

wherein X represents a hydrogen atom or a group which can become a hydrogen atom by hydrolytic action, Time represents a divalent connecting group, t represents 0 or 1, PUG represents a development inhibitor, V represents a carbonyl group, $$\text{-}\underset{\underset{\displaystyle O}{\|}}{\mathrm{C}}\text{-}\underset{\underset{\displaystyle O}{\|}}{\mathrm{C}}\text{-},$$

a sulfonyl group, a sulfoxy group, $$\text{-}\overset{\overset{\displaystyle O}{\|}}{\underset{\underset{\displaystyle R_0}{|}}{\mathrm{P}}}\text{-}$$

($R_0$ represents an alkoxy group or an aryloxy group), an iminomethylene group, a thiocarbonyl group or $$\text{-}\underset{\underset{\displaystyle W}{|}}{\mathrm{CH}}\text{-}\mathrm{CH_2}\text{-}$$

(W represents an electron attractive group), R represents a hydrogen atom, a substituted or unsubstituted aliphatic group, a substituted or unsubstituted aromatic group, or $$\mathrm{PUG}\text{-}(\mathrm{Time})_t\text{-}\underset{\underset{\displaystyle W}{|}}{\mathrm{CH}}\text{-}\mathrm{CH_2}\text{-}$$

(PUG, Time, t and W are as defined above); and at least one compound represented by formula (II):

$$R_1\text{-}\underset{\underset{\displaystyle A_1}{|}}{\mathrm{N}}\text{-}\underset{\underset{\displaystyle A_2}{|}}{\mathrm{N}}\text{-}G_1\text{-}R_2 \qquad \text{(II)}$$

wherein $R_1$ represents a substituted or unsubstituted aliphatic group or a substituted or unsubstituted aromatic group, $R_2$ represents a hydrogen atom, an alkyl group, an aryl group, an alkoxy group, an aryloxy group, an amino group, a hydrazino group, a carbamoyl group or an oxycarbonyl group, each of which may be substituted, $G_1$ represents a carbonyl group, a sulfonyl group, a sulfoxy group,

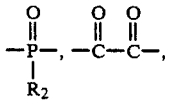

a thiocarbonyl group, or an iminomethylene group, $A_1$ and $A_2$ each represents a hydrogen atom, or one of $A_1$ and $A_2$ represents a hydrogen atom while the other represents a substituted or unsubstituted alkylsulfonyl group, a substituted or unsubstituted arylsulfonyl group, or a substituted or unsubstituted acyl group.

18 Claims, 1 Drawing Sheet

SILVER HALIDE PHOTOGRAPHIC MATERIAL

FIELD OF THE INVENTION

The present invention relates to silver halide photographic materials, and in particular, to silver halide photographic materials giving contrasty negative images, high sensitivity negative images, and good dot picture quality.

BACKGROUND OF THE INVENTION

In the field of photoengraving, in order to adequately deal with the diversity and complexity of printed matter, photographic materials with good reproducibility of the original, stable processing solutions and/or simplified replenishing are desirable.

In particular, in the process of photographing line originals, the original is prepared by sticking photocomposed characters, handwritten characters, illustrations, halftone photographs and the like. Accordingly, in the original, images of differing line width and density are often mixed. Finishing process cameras, photographic materials and image formation methods giving good reproduction of these originals are greatly desired. On the other hand, in the photographing of catalogs and large posters, enlargement of dot photographs (extension) or reduction (contraction) are widely performed by photoengraving using enlarging of dots, but the number of lines becomes coarse, and thus results in the photographing of unfocused points. In reduction, the line number per inch becomes greater and gives rise to a photograph of fine points. Accordingly, in order to maintain reproducibility of dot gradation, an image formation method possessing wider latitude is necessary.

Halogen lamps or xenon lamps are used as the light source for process cameras. For sensitivity to these light sources, usually orthosensitization of photographic materials is performed. However, orthosensitized photographic materials are too strongly influenced by the chromatic aberration of lenses, and it was ascertained that image quality easily deteriorates because of this. Further, this deterioration is more conspicuous for xenon light sources.

As a system responding to the requirement for wide latitude, lith type silver halide photographic materials consisting of silver chlorobromide (at least 50% silver chloride content), processed in hydroquinone developer solution with greatly reduced effective concentration of sulfite ion (usually 0.1 mol/liter or less), is a known method of obtaining line originals and dot images having high contrast and high density of blackening, with the image part and nonimage part clearly separated. However, in this method, because the sulfite concentration in the developer solution is low, development is very unstable to air oxidation, and to maintain stability of solution activity various endeavors and contrivances have been made and utilized; the state of the art was such that processing speed was conspicuously slow, and operating efficiency was reduced.

Because of this, a developing method as mentioned above (lith development system) to remedy the instability of image formation, to develop using processing solutions possessing well-maintained stability, an image formation system possessing supercontrasty photographic properties is desired. One such system, as exemplified in U.S. Pat. Nos. 4,166,742, 4,168,977, 4,221,857, 4,224,401, 4,243,739, 4,272,606 and 4,311,781 was proposed, wherein a specific acylhydrazine compound is added to surface latent image type silver halide photographic materials at pH 11.0 to 12.3 containing 0.15 mol/liter or more of sulfite preservative, then the material is processed with a developer possessing well-maintained stability, thus forming supercontrasty negative images with gamma exceeding 10. In this type of image formation system, in contrast to prior supercontrasty image formation in which only silver chlorobromide having a high silver chloride content could be utilized, the advantage is that silver iodobromide and silver chloroiodobromide can also be utilized.

The imaging system mentioned above exhibits sharp dot quality, processing stability and speed, and excellent performance in reproduction of the original, but to satisfactorily deal with the diversity of printed matter in recent years, systems giving further improvement in reproducibility of the original are demanded.

On the other hand, in the operation of gathering and contact processes, an increase in processing performance has been achieved by performing operations in brighter surroundings, and because of this, operations can be carried out substantially in daylight surroundings. Thus, development of photosensitive materials for photoengraving and development of exposure printers has advanced.

Daylight use photosensitive materials as described herein are photosensitive materials which can be used with long term stability, using as a safelight a light having long wavelengths of substantially 400 nm or above and not containing any ultraviolet light component.

Daylight photosensitive materials, used in gathering and contact processes, may contain developed film of characters or formed dot images as the original. These originals and reversal photosensitive materials are contact exposed, and negative image/positive image reversal or positive/negative image reversal is performed. These materials are required: (1) to possess negative image/positive image reversal with a capacity for dot imaging and line imaging, and character imaging, each according to their dot area and line width, and character image width, respectively; and (2) to possess a capacity whereby controllability of dot image tone, and controllability of character image line width are possible. So far, daylight contact photosensitive materials capable of meeting such requirements have been provided.

However, in a high level of image conversion work for forming white-on-black letter images through the superimposition contact work, the conventional method of using a daylight photosensitive material and carrying out the contact work in daylight had a defect of providing white-on-black letter images inferior in quality to those provided by the method of using a conventional dark-room contact photosensitive material and carrying out the contact work in dark room.

The method of forming white-on-black letter images through the superimposition contact work is described in more detail below.

As shown in FIG. 1 hereinafter, a letter or line imageformed film (line original) (b) stuck to a transparent or translucent base (a) and a dot imageformed film (dot original) (d) stuck to a transparent or translucent base (c) (wherein a polyethylene terephthalate film having a thickness of about 100 μm is generally used as the sticking base) are superposed, and employed as an original. The emulsion surface of a contact photosensitive material (e) is brought into direct contact with the dot original (d), and subjected to optical exposure.

After the exposure, the contact photosensitive material is development-processed to produce white areas corresponding to line images inside the black dot images.

A point of importance in the above described method for forming white-on-black letter images is that the ideal of negative image/positive image conversion consists in accomplishing the conversion in accordance with individual dot areas of a dot original and individual line widths of a line original, respectively. However, as apparent from FIG. 1, the exposure for printing the line original on the contact photosensitive material is carried out in a condition that the sticking base (c) and the dot original (d) are sandwiched in therebetween, in contrast to the exposure carried out in a condition that the dot original (d) is in direct contact with the emulsion surface of the contact photosensitive material.

Therefore, an exposure determined as optimum for accomplishing faithful negative image/positive image conversion with respect to the dot original is out of focus for the line original because the sticking base (c) and the dot image (d) are interposed as a spacer. As the result, narrowing of the line width of white-printed image corresponding to the line original is caused. This is responsible for deterioration in quality of the white-on-black letter image.

With the intention of dissolving the above described point at issue, systems using a hydrazine compound are disclosed in JP-A-62-80640 (the term "JP-A" as used herein refers to a "published unexamined Japanese patent application"), JP-A-62-235938, JP-A-62-235939, JP-A-63-104046, JP-A-63-103235, JP-A-63-296031, JP-A-63-314541 and JP-A-64-13545. However, these systems cannot be said to be satisfactory, so it is to be desired that further improvements should be introduced thereinto.

As an attempt for making an improvement in image quality, there has been known a method of releasing a development inhibitor in such a distribution as to correspond to silver image from a redox compound containing a carbonyl group, as disclosed, e.g., in JP-A-61-213847 and JP-A-64-72139.

Furthermore, hydrazine was used in the redox compounds of the above mentioned patent disclosures, with the advantages of sharp dot quality, processing stability (for example, changes in the images were small in relation to changes in the developer composition, e.g., pH, sodium sulfite and the like), and the like, but these were insufficient in certain respects.

Accordingly, it was desirable to develop a photographic material using a stable developer forming contrasty dot images and also a wide tone control of the image.

SUMMARY OF THE INVENTION

One object of the present invention is to provide a photographic material possessing wide exposure latitude in photographing line images, and which is supercontrasty (particularly with a gamma value of 10 or more) with high resolution.

Another object of the present invention is to provide a supercontrasty photographic material which reproduces line originals well and with high background density (Dmax).

Yet another object of the present invention is to provide a supercontrasty photographic material of wide exposure latitude in photographing dot images which also has excellent dot quality on completion of formation of high density dots with clear contours.

A further object of the present invention is to provide a supercontrasty photographic material in which the change in the obtained image is small even with changes in the developer solution composition.

Still another object of the present invention is to provide a photographic material which can be handled in daylight, and in particular has good quality of white-on-black characters, and furthermore, no traces of sticking tape appear.

Still a further object of the present invention is to provide a silver halide photographic material which is easily constructed and has excellent storage stability, contains a hydroxylamine derivative and has good stability over time.

The above and other objects and advantages of the present invention are achieved by a silver halide photographic material comprising at least one compound represented by formula (I):

$$\mathrm{PUG}\text{-}(\mathrm{Time})_t\text{-}\mathrm{V}\text{-}\overset{\overset{\displaystyle R}{|}}{\mathrm{N}}\text{-}\mathrm{O}\text{-}\mathrm{X} \qquad \text{(I)}$$

wherein X represents a hydrogen atom or a group which can become a hydrogen atom by hydrolytic action, Time represents a divalent connecting group, t represents 0 or 1, PUG represents a development inhibitor, V represents a carbonyl group, $$-\underset{\underset{\displaystyle O}{\|}}{\mathrm{C}}-\underset{\underset{\displaystyle O}{\|}}{\mathrm{C}}-.$$

a sulfonyl group, a sulfoxy group, $$-\overset{\overset{\displaystyle O}{\|}}{\underset{\underset{\displaystyle R_0}{|}}{\mathrm{P}}}-$$

($R_0$ represents an alkoxy group or an aryloxy group), an iminomethylene group, a thiocarbonyl group or $$-\underset{\underset{\displaystyle W}{|}}{\mathrm{CH}}-\mathrm{CH_2}-$$

(W represents an electron attractive group), R represents a hydrogen atom, a substituted or unsubstituted aliphatic group, a substituted or unsubstituted aromatic group, or $$\mathrm{PUG}\text{-}(\mathrm{Time})_t\text{-}\underset{\underset{\displaystyle W}{|}}{\mathrm{CH}}-\mathrm{CH_2}-$$

(PUG, Time, t and W are as defined above); and at least one compound represented by formula (II):

$$\mathrm{R_1}-\underset{\underset{\displaystyle A_1}{|}}{\mathrm{N}}-\underset{\underset{\displaystyle A_2}{|}}{\mathrm{N}}-\mathrm{G_1}-\mathrm{R_2} \qquad \text{(II)}$$

wherein $R_1$ represents a substituted or unsubstituted aliphatic group or a substituted or unsubstituted aromatic group, $R_2$ represents a hydrogen atom, an alkyl group, an aryl group, an alkoxy group, an aryloxy group, an amino group, a hydrazino group, a carbamoyl group or an oxycarbonyl group, each of which may be substituted, $G_1$ represents a carbonyl group, a sulfonyl group, a sulfoxy group,

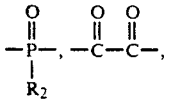

a thiocarbonyl group, or an iminomethylene group, $A_1$ and $A_2$ each represents a hydrogen atom, or one of $A_1$ and $A_2$ represents a hydrogen atom while the other represents a substituted or unsubstituted alkylsulfonyl group, a substituted or unsubstituted arylsulfonyl group, or a substituted or unsubstituted acyl group.

Figure 1:
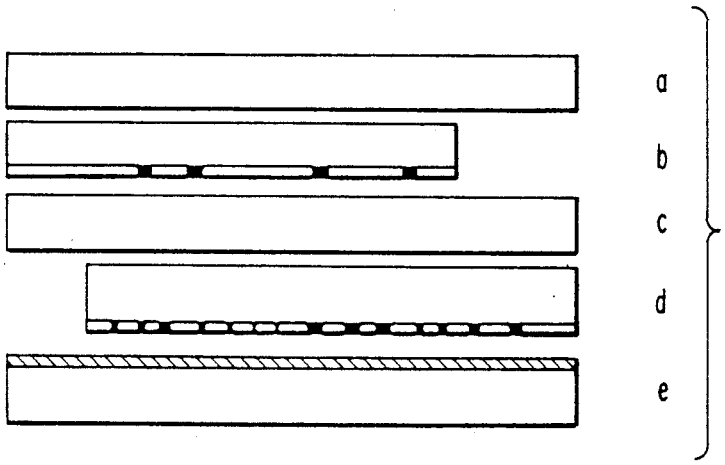
FIG. 1 depicts an embodiment of a photographic material in which white-on-black character imaging is performed by superposed reversal; the structure during exposure is shown, and the reference numbers indicate the following features.

(a) Transparent or semitransparent sticking base
(b) Line image original (showing black parts of line images)
(c) Transparent or semitransparent sticking base
(d) Dot original (showing black parts of dots)
(e) Photosensitive contact material (oblique shaded portion shows the photosensitive layer).

DETAILED DESCRIPTION OF THE INVENTION

Formula (I) is explained in more detail below.

When X represents a group which can become a hydrogen atom by a hydrolytic reaction, specific examples include blocking groups for photographic reagents, any number of which are known; for example, those groups utilized as acyl and sulfonyl blocking groups as disclosed in JP-B-48-9968 (the term "JP-B" as used herein refers to an "examined Japanese patent publication"), JP-A-52-8828, JP-A-57-82834, U.S. Pat. No. 3,311,476, JP-B47-44805 (U.S. Pat. No. 3,615,617); those groups utilized as blocking groups discharging photographic reagents by a so-called reverse Michael reaction, as disclosed in JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175), JP-A-59-105642 and JP-A-59-105640; those groups utilized as blocking groups discharging photographic reagents by the intramolecular transfer of electrons, accompanying the formation of quinonemethido or quinonemethido type compounds, as disclosed in JP-B-54-39727, U.S. Pat. Nos. 3,674,478, 3,932,480, 3,993,661, JP-A-57-135944, JP-A-57-135945 and JP-A-57-136640; those groups utilizing intramolecular ring closure reactions, as disclosed in JP-A-55-53330 and JP-A-59-218439; those groups utilizing the opening of 5-membered or 6-membered rings, as disclosed in JP-A-57-76541 (U.S. Pat. No. 4,335,200), JP-A-57-135949, JP-A-57-179842, JP-A-59-137945, JP-A-59-140445, JP-A-59-219741 and JP-A-60-41034; those groups utilized as blocking groups discharging photographic reagents by a Michael reaction, as disclosed in JP-A-59-201057, JP-A-61-43739, JP-A-61-95346 and JP-A-61-95347; and those groups utilized as imidomethyl and the like blocking groups, as disclosed in JP-A-57-158638.

Time represents a divalent connecting group, and may possess a timing control mechanism. t represents 0 or 1; $t \stackrel{?}{=} 0$ means that PUG is directly bonded to V.

The divalent connecting group represented by Time represents a group which releases PUG in a reaction of one or more stages from Time-PUG which has been released from an oxidation product of an oxidation reduction nucleus.

Suitable divalent connecting groups represented by Time include those releasing a photographically useful group (PUG) by means of an intramolecular ring closing reaction of a p-nitrophenoxy derivative as disclosed, for example, in U.S. Pat. No. 4,248,962 (JP-A-54-145135); those groups releasing (PUG) by means of an intramolecular ring closing reaction after ring opening, as disclosed in U.S. Pat. Nos. 4,310,612 (JP-A-55-53330) and 4,330,617; those groups releasing PUG accompanying acid anhydride formation by means of an intramolecular ring closing reaction of the carboxyl group of a succinic acid monoester or its analogs, as disclosed in U.S. Pat. Nos. 4,483,919, 4,446,216, 4,483,919, and JP-A-59-121328; those groups releasing PUG with the formation of quinomonomethane or its analogs by electron migration via conjugated double bonds of aryloxy groups or heterocyclic oxy groups, as disclosed in U.S. Pat. Nos. 4,409,323 and 4,421,845, Research Disclosure, No. 21228 (December, 1981), U.S. Pat. No. 4,416,977 (JP-A-57-135944), JP-A-58-209736 and JP-A-58-209738; those groups releasing PUG from the gamma position of an enamine by electron transfer of a portion possessing a nitrogen heterocyclic enamine structure, as disclosed in U.S. Pat. No. 4,420,554 (JP-A-57-136640), JP-A-57-135945, JP-A-57-188035, JP-A-58-98728 and JP-$A_{58}$-209737; those groups releasing PUG by an intramolecular ring closing reaction of an oxy group formed by electron transfer to a carbonyl group conjugated with a nitrogen atom of a nitrogen-containing heterocyclic group, as disclosed in JP-A-57-56837; those groups releasing PUG accompanying the formation of aldehydes, as disclosed in U.S. Pat. No. 4,146,396 (JP-A-52-90932), JP-A-59-93442 and JP-A-59-75475; those groups releasing PUG accompanying the decarboxylation of a carboxyl group, as disclosed in JP-A-51-146828, JP-A-57-179842 and JP-A-59-104641; those groups releasing PUG accompanying the formation of aldehydes succeeding decarboxylation in an —O—COOCR —PUG structure in which $R_a$ and $R_b$ each represents a hydrogen atom, an aliphatic group, an aromatic group or a heterocyclic group; those groups releasing PUG accompanying the formation of isocyanates, as disclosed in JP-A-60-7429; and those groups releasing PUG by the coupling reaction of the oxidation product of a color developer, as disclosed in U.S. Pat. No. 4,438,193.

Details are disclosed in JP-A-61-236549 and JP-A-1-269936, etc., of these divalent connecting groups represented by Time, and specific examples are given below.

In these examples, (*) represents the site, in formula (I), at which -(Time)$_t$-PUG is bonded to V; and (*)(*) represents the sites at which PUG bonds.

T-(1)
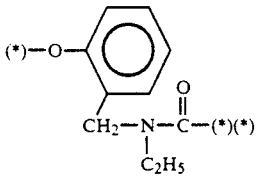
T-(2)
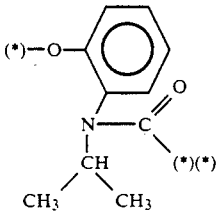
T-(3)
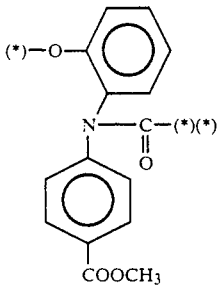
T-(4)
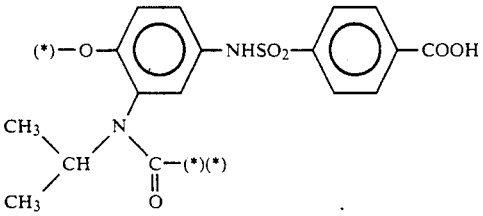
T-(5)
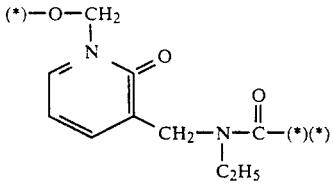
T-(6)
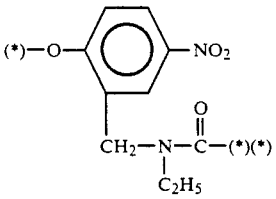
T-(7)
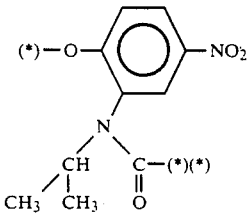
-continued
T-(8)
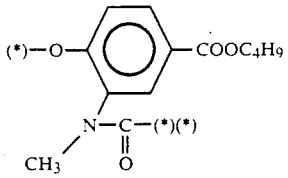
T-(9)
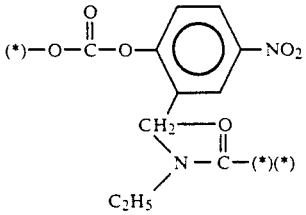
T-(10)
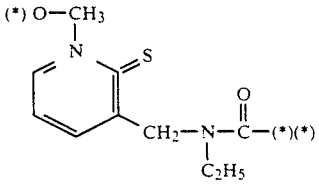
T-(11)
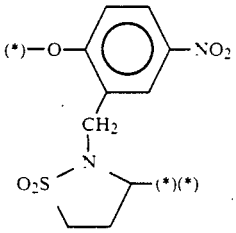
T-(12)
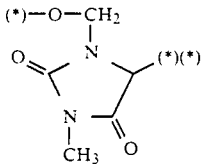
T-(13)
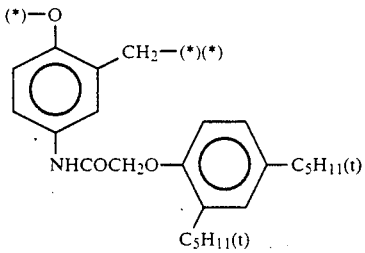
T-(14)
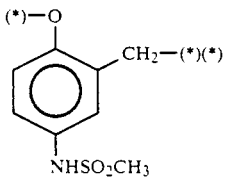
T-(15)
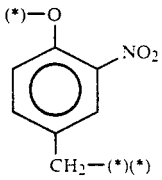

-continued
T-(16)
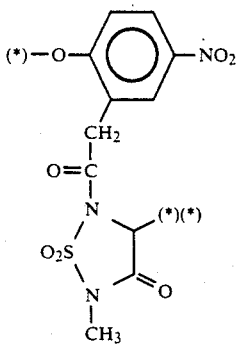
T-(17)
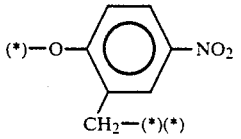
T-(18)
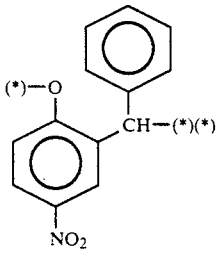
T-(19)
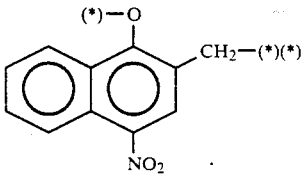
T-(20)
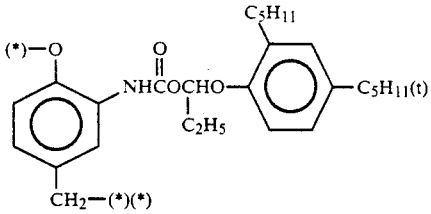
T-(21)
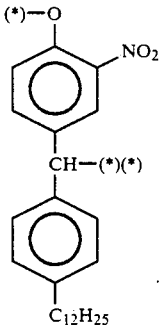
T-(22)
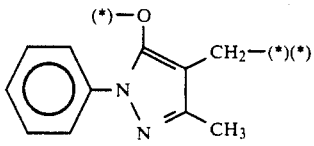
-continued
T-(23)
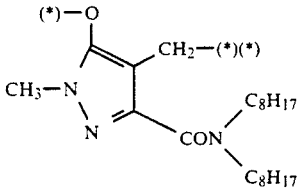
T-(24)
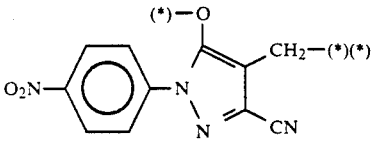
T-(25)
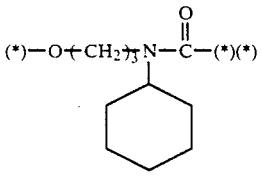
T-(26)
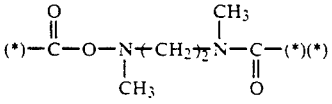
T-(27)
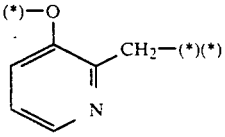
T-(28)
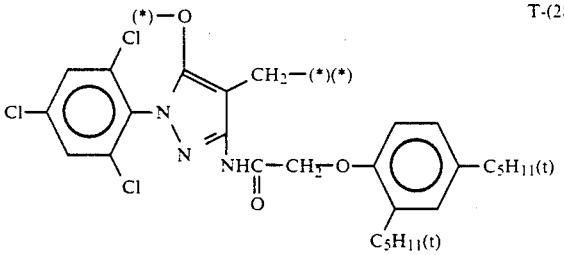
T-(29)
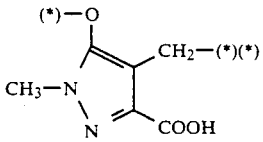
T-(30)
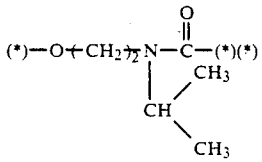
T-(31)
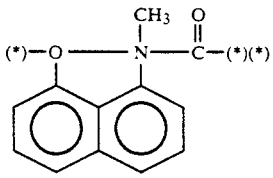
T-(32)
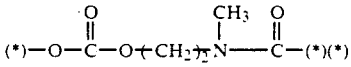

-continued

T-(33) $(*)-O-CH_2-(*)(*)$

T-(34) $(*)-O-CH(COOC_2H_5)-(*)(*)$

T-(35) 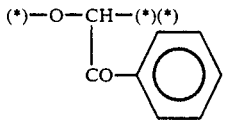

T-(36) 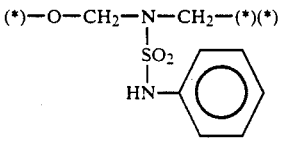

T-(37) 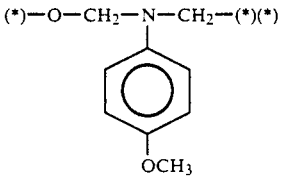

T-(38) 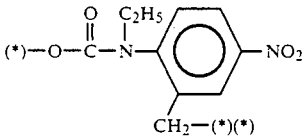

T-(39) 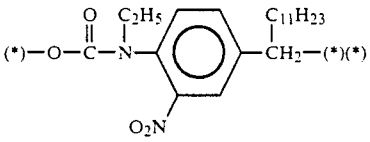

T-(40) 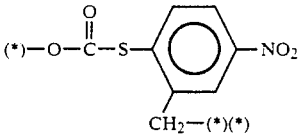

T-(41) 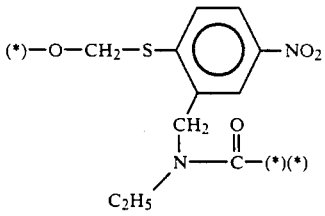

T-(42) 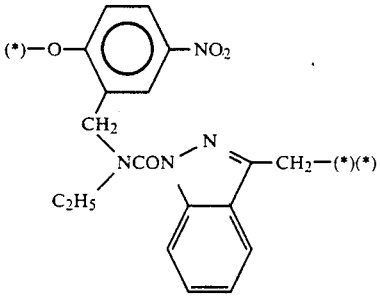

PUG represents a group which, as $(Time)_t$-PUG or PUG, has a development inhibiting effect.

The development inhibitors represented by PUG or $(Time)_t$PUG are known development inhibitors containing a hetero atom and bonded via the hetero atom; suitable ones are disclosed, for example, in C. E. K. Mees and T. H. James, *The Theory of Photographic Processes,* 3rd Ed., Macmillan, 1966, pp. 344 to 346. Specific examples include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, mercaptoaryls and the like.

The development inhibitor represented by PUG may be substituted. Specific substituents include the following groups, but these substituent groups may also be substituted themselves.

For example, suitable substituent groups include alkyl, aralkyl, alkenyl, alkynyl, alkoxy, aryl, substituted amino, acylamino, sulfonylamino, ureido, urethane, aryloxy, sulfamoyl, carbamoyl, alkylthio, arylthio, sulfonyl, sulfinyl, hydroxy, halogen atoms, cyano, sulfo, alkyloxycarbonyl, aryloxycarbonyl, acyl, alkoxycarbonyl, acyloxy, carboxamido, sulfonamido, carboxyl, sulfoxy, phosphono, phosphinico, and phosphoramido groups.

Preferred substituents are nitro, sulfo, carboxyl, sulfamoyl, phosphono, phosphinico and sulfonamido groups.

Further, the development inhibitors may become compounds possessing development inhibiting properties after they have been released from the oxidation reduction nucleus of formula (I) by a continued reduction reaction of the oxidation reduction reaction in the development processing process. Also, the development inhibitors may change into compounds which substantially do not possess, or possess markedly reduced, development inhibiting properties.

Preferred development inhibitors are shown below:

1. Mercaptotetrazole Derivatives:

(1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(3-Sulfophenyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole

(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole
(32) 1-(2-Diethylaminoethyl)-5-mercaptotetrazole
(33) 2-(5-Mercapto-1-tetrazolo)ethyltrimethylammonium Chloride
(34) 1-(3-Phenoxydicarbonylphenyl)-5-mercaptotetrazole
(35) 1-(3-Maleimidophenyl)-5-mercaptotetrazole 2. Mercaptotriazole Derivatives:
(1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole Derivatives:
(1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptopyrimidine Derivatives:
(1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Derivatives:
(1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chlorobromide,-2-mercaptobenzimidazole
(6) 5-Methoxy-2-mercaptobenzimidazole
(7) 2-Mercaptonaphthimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Derivatives:
(1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole 7. Mercaptobenzothiazole Derivatives:
(1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole 8. Mercaptobenzoxazole Derivatives:
(1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole 9. Benzotriazole Derivatives:
(1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole, Na Salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10. Benzimidazole Derivatives:
(1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole 11. Indazole Derivatives:
(1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chlorobromide,-5-nitroindazole
(9) 3-Carboxy-5-nitroindazole 12. Tetrazole Derivatives:
(1) 5-(4-Nitrophenyl)tetrazole
(2) 5-Phenyltetrazole
(3) 5-(3-Carboxyphenyl)tetrazole 13. Tetraazaindene Derivatives:
(1) 4-Hydroxy-6-methyl-5-nitro-1,3,3*a*,7-tetraazaindene
(2) 4-Mercapto-6-methyl-5-nitro-1,3,3*a*,7-tetraazaindene 14. Mercaptoaryl Derivatives:
(1) 4-Nitrothiophenol
(2) Thiophenol
(3) 2-Carboxythiophenol V represents a carbonyl group,

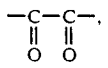

a sulfonyl group, a sulfoxy group,

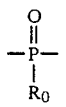

($R_0$ represents an alkoxy group or an aryloxy group), an iminomethylene group, a thiocarbonyl group, or,

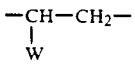

(W represents an electron attractive group). W is preferably a group which possesses a Hammett $\sigma_{para}$ value exceeding 0.3, for example, a cyano group, a nitro group, a 1-30 carbon substituted or unsubstituted carbamoyl group (for example, methylcarbamoyl, ethylcarbamoyl, 4-methoxycarbamoyl, N-methyl-N-octadecylcarbamoyl, 3-(2,4-di-t-pentylphenoxy)propylcarbamoyl, pyrrolidinocarbamoyl, hexadecylcarbamoyl, di-n-octylcarbamoyl), a 1-30 carbon substituted or unsubstituted sulfamoyl group (for example, methylsulfamoyl, diethylsulfamoyl, 3-(2,4-di-t-pentylphenoxy)-propylsulfamoyl, phenylsulfamoyl, pyrrolidinosulfonyl, morpholinosulfonyl), a 1-30 carbon substituted or unsubstituted alkoxycarbonyl group (for example, methoxycarbonyl, ethoxycarbonyl, phenoxycarbonyl, 2-methoxyethoxycarbonyl, hexadecyloxycarbonyl), a 1-30 carbon substituted or unsubstituted sulfonyl group (for example, methanesulfonyl, 4-methylphenylsulfonyl, dodecylsulfonyl), a 1-30 carbon substituted or unsubstituted acyl group (for example, acetyl, hexanoyl, benzoyl, 4-chlorobenzoyl), a trifluoromethyl group, a carboxyl group, a 1-30 carbon substituted or unsubstituted heterocyclic group (for example, benzoxazol-2-yl, 5,5-dimethyl-2-oxazolin-2-yl), and the like, but carbamoyl groups, alkoxycarbonyl groups, and sulfamoyl groups are particularly preferred as W.

V is preferably a carbonyl group.

R represents a hydrogen atom, an aliphatic group, an aromatic group or PUG(Time)t

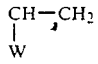

(wherein PUG, Time, t and W are as defined above).

The aliphatic group represented by R includes straight chain, branched or cyclic aliphatic groups, alkenyl groups or alkynyl groups.

The aromatic group represented by R includes monocyclic or bicyclic aryl groups or unsaturated heterocyclics, for example, phenyl, naphthyl, and pyridyl groups.

R can be substituted with substituent groups. The following are mentioned as exemplary substituent groups. These substituent groups may also be further substituted.

Suitable substituent groups include alkyl, aralkyl, alkenyl, alkynyl, alkoxy, aryl, substituted amino, acylamino, sulfonylamino, ureido, urethane, aryloxy, sulfamoyl, carbamoyl, aryl, alkylthio, arylthio, sulfonyl, sulfinyl, hydroxy, halogen atom, cyano, sulfo groups, and carboxyl, aryloxycarbonyl, acyl, alkoxycarbonyl, acyloxy, carbonamido, sulfonamido, nitro, alkylthio, arylthio, and the like.

These substituent groups may form a ring by bonding together, where possible.

R is preferably a hydrogen atom, an alkyl group or an aryl group; a hydrogen atom is particularly preferred.

Specific examples of the compounds represented by formula (I) are mentioned below, but these in no way limit the present invention.

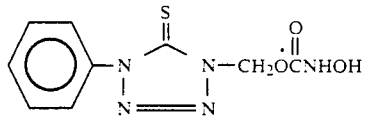

I-1

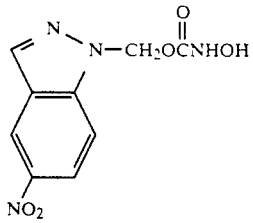

I-2

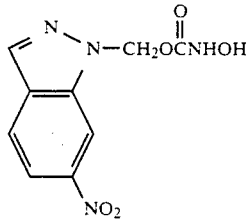

I-3

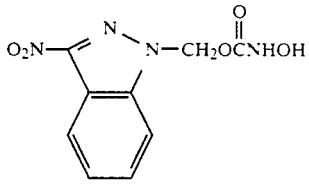

I-4

-continued
I-5
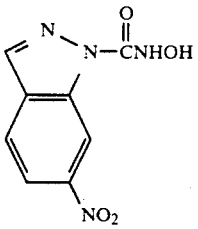
I-6
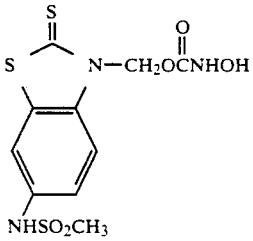
I-7
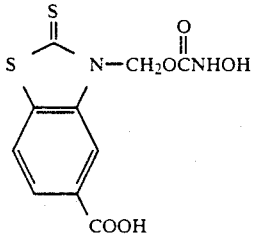
I-8
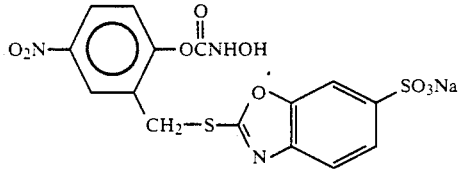
I-9
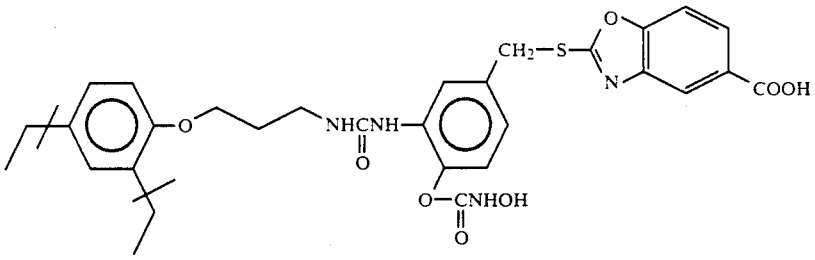
I-10
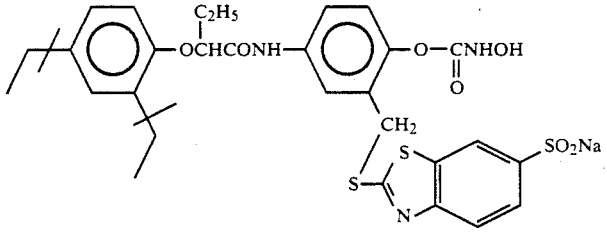
I-11
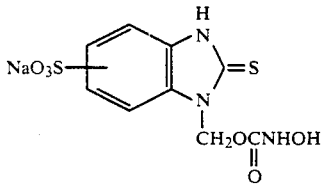

-continued
I-12
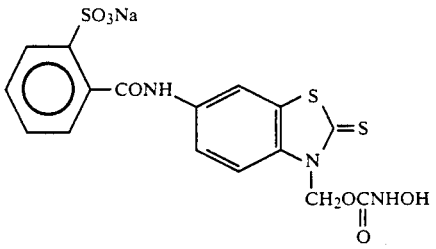
I-13
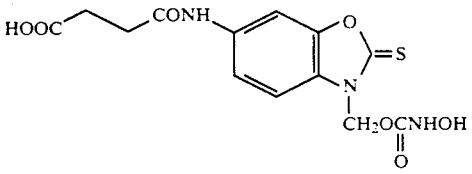
I-14
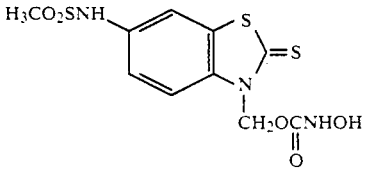
I-15
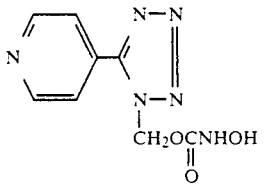
I-16
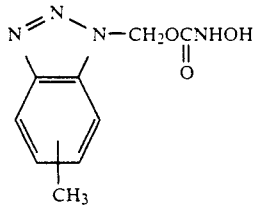
I-17
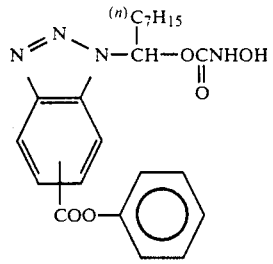
I-18
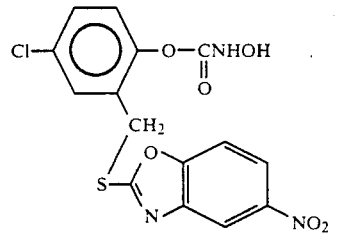

-continued
I-19
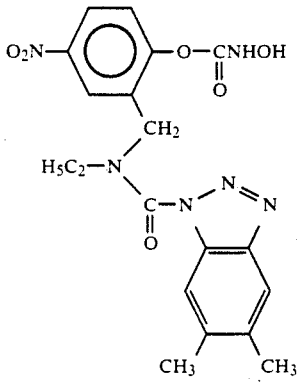
I-20
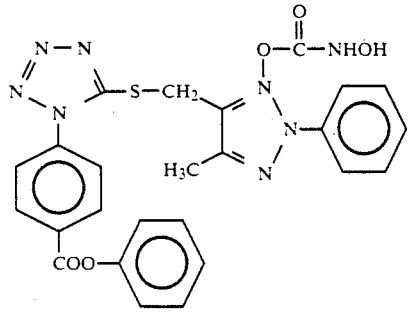
I-21
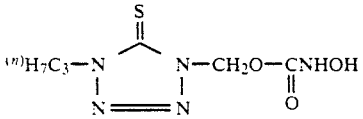
I-22
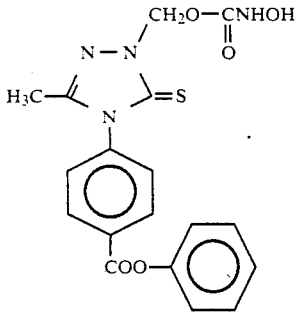
I-23
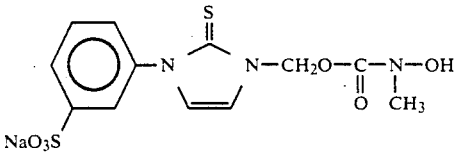
I-24
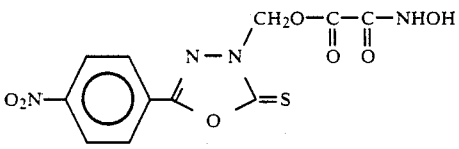
I-25
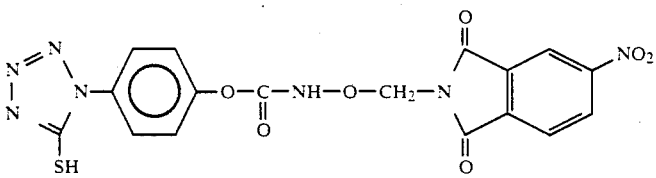

-continued
I-26
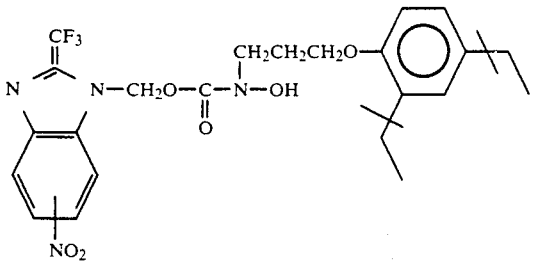
I-27
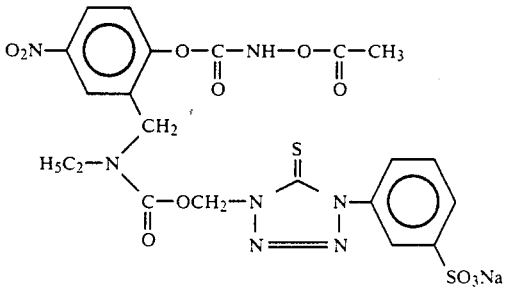
I-28
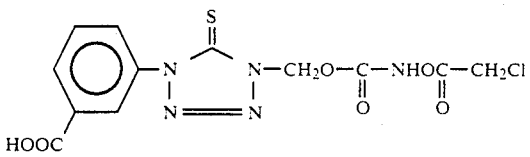
I-29
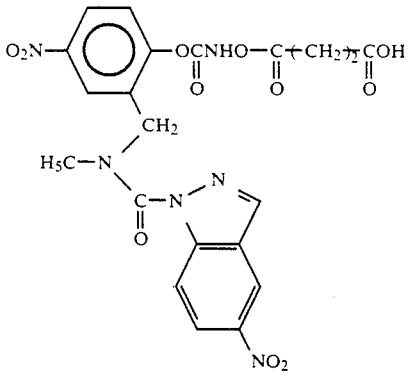
I-30
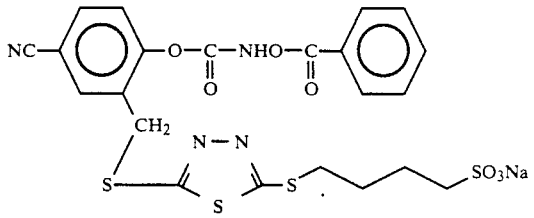
I-31
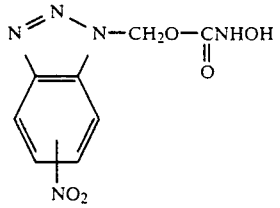

-continued
I-32
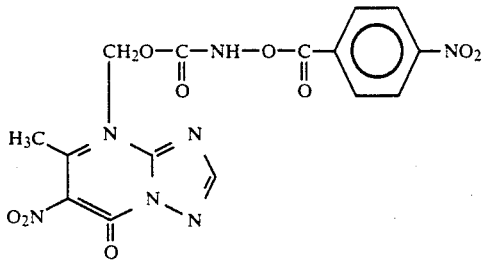
I-33
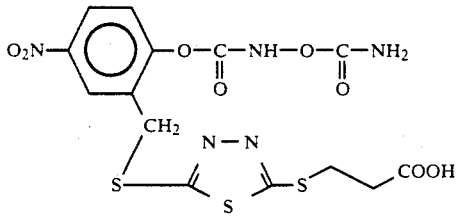
I-34
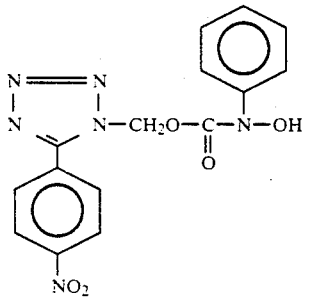
I-35
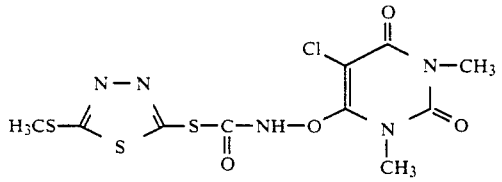
I-36
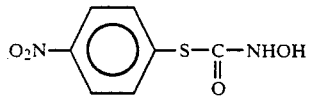
I-37
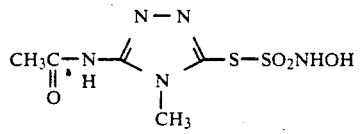
I-38
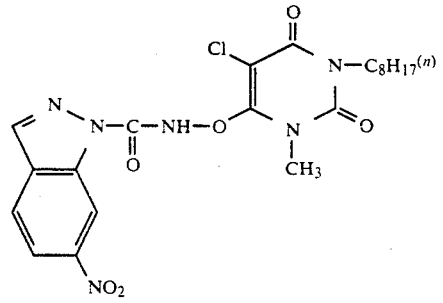

-continued
I-39
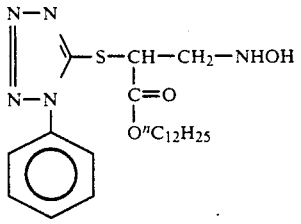
I-40
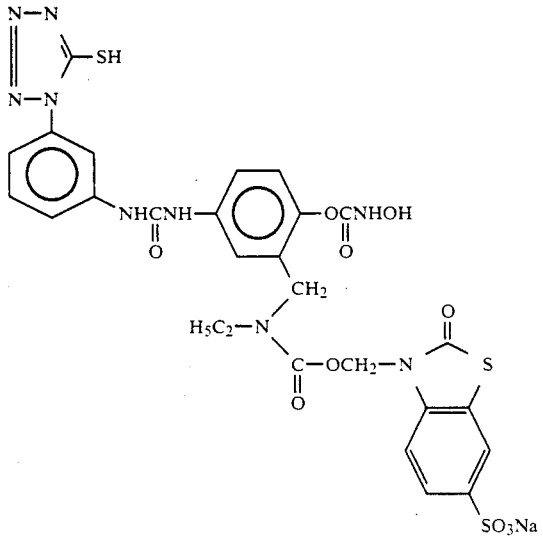
I-41
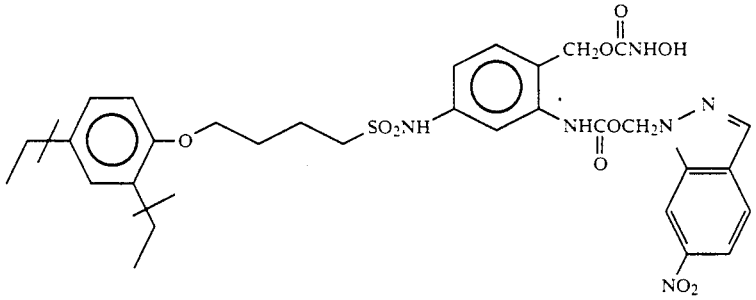
I-42
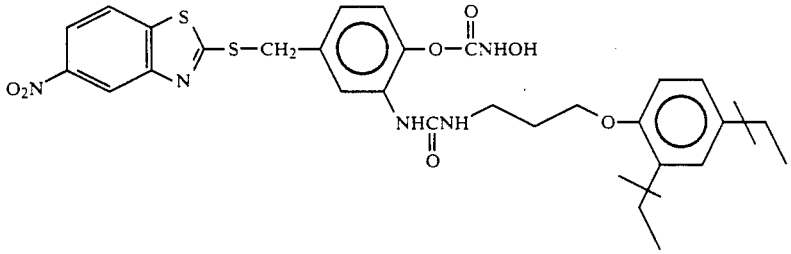
I-43
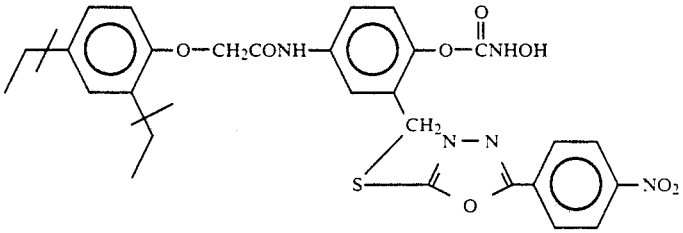

-continued
I-44
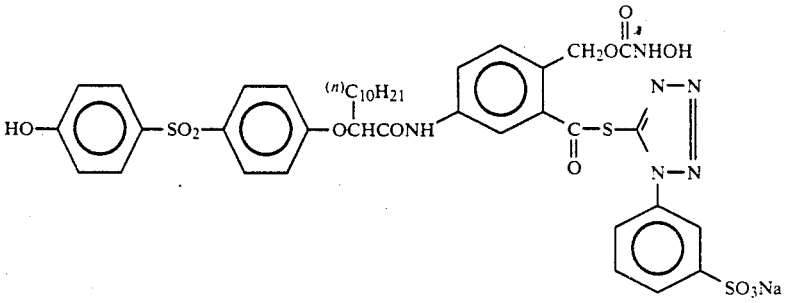
I-45
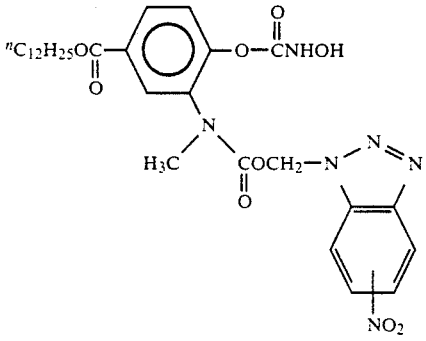
I-46
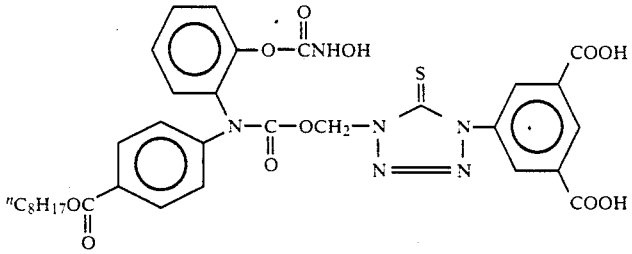
I-47
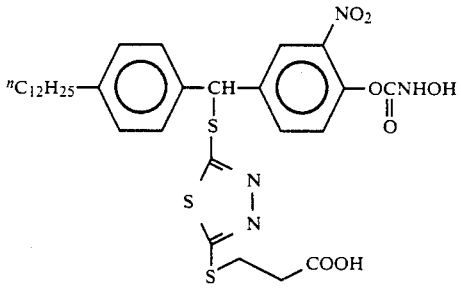
I-48
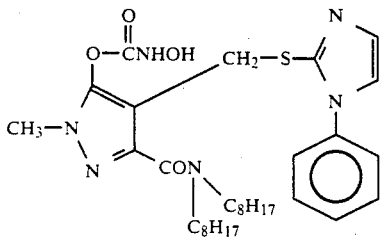

-continued

I-49

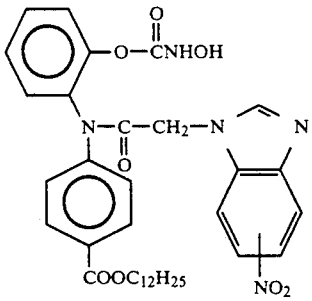

Suitable methods of synthesis of the compounds of formula (I) used in the present invention are disclosed, for example, in Japanese Patent Application No. 63-98803.

A detailed explanation of formula (II) is given next.

In formula (II), the aliphatic group represented by $R_1$ is a 1-30 carbon group, in particular, a 1-20 carbon straight chain, branched or cyclic alkyl group. In this case, the branched alkyl group may be cyclized, with one or more hetero atoms in it, to form a saturated heterocycle. Further, this alkyl group may contain substituent group(s) such as aryl, alkoxy, sulfoxy, sulfonamido or carbonamido and the like.

The aromatic group represented by $R_1$ in formula (II) is a monocyclic or bicyclic aryl group or an unsaturated heterocyclic group. The unsaturated heterocyclic group may form a heteroaryl group condensed with a monocyclic or bicyclic aryl group.

For example, $R_1$ may be a benzene ring, naphthylene ring, pyridine ring, pyrimidine ring, imidazole ring, pyrazole ring, quinoline ring, isoquinoline ring, benzimidazole ring, thiazole ring, or a benzothiazole ring, but among these a benzene ring is preferred.

$R_1$ is particularly preferably an aryl ring.

The aryl group or heterocyclic group of $R_1$ may be substituted; representative substituent groups include, for example, alkyl, aralkyl, alkenyl, alkynyl, alkoxy, aryl, substituted amino, acylamino, sulfonylamino, ureido, urethane, aryloxy, sulfamoyl, carbamoyl, alkylthio, arylthio, sulfonyl, sulfinyl, hydroxy, halogen atom, cyano, sulfo, alkyloxycarbonyl, aryloxycarbonyl, acyl, alkoxycarbonyl, acyloxy, carbonamido, sulfonamido or carboxyl, phosphoramido, diacylamino, imido,

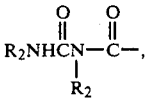

and the like; preferred substituent groups are straight chain, branched or cyclic alkyl groups (preferably with 1-20 carbons), aralkyl groups (preferably monocyclic or bicyclic, with 1-3 carbons in the alkyl moiety), alkoxy groups (preferably 1-20 carbons), substituted amino groups (preferably amino groups substituted with 1-20 carbon alkyl groups), acylamino groups (preferably having 2-30 carbons), sulfonamido groups (preferably having 1-30 carbons), ureido groups (preferably having 1-30 carbons), phosphoramido groups (preferably 1-30 carbons), and the like.

The alkyl groups represented by $R_2$ in formula (II) are preferably 1-4 carbon alkyl groups; they may possess as substituents, for example, halogen atoms, cyano, carboxy, sulfo, alkoxy, phenyl, acyl, alkoxycarbonyl, aryloxycarbonyl, carbamoyl, alkylsulfo, arylsulfo, sulfamoyl, nitro, aromatic hetero,

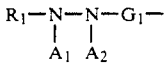

(wherein $R_1$, $A_1$, $A_2$ and $G_1$ are as defined under formula (II)), and the like substituent groups, and furthermore these substituent groups may be substituted.

Monocyclic or bicyclic aryl groups are preferable as the aryl groups for $R_2$, for example, those containing benzene rings. These aryl groups may be substituted, and examples of suitable substituents are similar to those for the alkyl groups represented by $R_2$.

As alkoxy groups, 1-8 carbon alkoxy groups are preferred, which may be substituted with halogen atoms, aryl groups, and the like.

As aryloxy groups, monocyclic ones are preferred, which may be substituted with halogen atoms, etc.

As amino groups, unsubstituted amino groups, 1-10 carbon alkylamino groups and arylamino groups are preferred, and they may be substituted with alkyl groups, halogen atoms, cyano groups, nitro groups, carboxy groups and the like.

As hydrazino groups, unsubstituted hydrazino groups, 1-10 carbon alkylhydrazino groups, and arylhydrazino groups are preferred; they may be substituted with alkyl groups, halogen atoms, cyano groups, nitro groups, amino groups, carbonamido groups, sulfonamido groups, and the like.

As carbamoyl groups, unsubstituted carbamoyl groups, 1-10 carbon alkylcarbamoyl groups, and arylcarbamoyl groups are preferred; they may be substituted with alkyl groups, halogen atoms, carboxy groups, and the like.

As oxycarbonyl groups, 1-10 carbon alkoxycarbonyl groups and aryloxycarbonyl groups are preferred; they may be substituted with alkyl groups, halogen atoms, cyano groups, nitro groups, and the like.

Preferred groups of those represented by $R_2$ are, when $G_1$ is a carbonyl group, a hydrogen atom, alkyl group (for example, methyl, trifluoromethyl, 3-hydroxypropyl, 3-methanesulfonamidopropyl, phenylsulfonylmethyl, and the like), aralkyl groups (for example, o-hydroxybenzyl, and the like), aryl groups (for example, phenyl, 3,5-dichlorophenyl, o-methanesulfonamidophenyl, 4-methanesulfonyl, and the like); hydrogen atoms are particularly preferred.

Further, when $G_1$ is a sulfonyl group, $R_2$ is preferably an alkyl group (for example, methyl and the like), an aralkyl group (for example, o-hydroxyphenylmethyl and the like), an aryl group (for example, phenyl and the like), or a substituted amino group (for example, dimethylamino and the like).

When $G_1$ is a sulfoxy group, $R_2$ is preferably a cyanobenzyl group, a methylthiobenzyl group and the like; when $G_1$ is

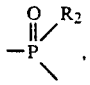

$R_2$ is preferably a methoxy group, ethoxy group, butoxy group, or phenoxy group; in particular, a phenoxy group is suitable.

When $G_1$ is an N-substituted or unsubstituted iminomethylene group, $R_2$ is preferably a methyl group, ethyl group, or a substituted or unsubstituted phenyl group.

The examples of substituent groups mentioned in relation to $R_1$ are also suitable as substituents for $R_2$ A carbonyl group is preferred as $G_1$ in formula (II).

Further, $R_2$ causes the $—G_1—R_2$ portion to be split off from the rest of- the molecule, and the $—G_1—R_2$ portion may contain an atom such that cyclization occurs to form a ring structure; specifically, it can be a portion as represented by formula (a):

$$—R_3—Z_1 \quad (a)$$

wherein $Z_1$ is a group which attacks $G_1$ nucleophilically to split off the $—G_1—R_3—Z_1$ portion from the remainder of the molecule, $R_3$ is from $R_2$ except for 1 hydrogen atom, $Z_1$ nucleophilically attacks $G_1$, and $G_1$, $R_3$, $Z_1$ are such that they can form a cyclic structure.

In more detail, $Z_1$, when the following reaction intermediate is formed by oxidation, etc., of formula (II) hydrazine compounds, easily reacts nucleophilically with $G_1$:

$$R_1—N=N—G_1—R_3—Z_1$$

The $R_1—N=N—$ group is a group which is caused to split off from the group $G_1$; specifically, OH, SH or $NHR_4$ ($R_4$ is a hydrogen atom, alkyl group, aryl group, $—COR_5$ or $—SO2R_5$; $R_5$ represents a hydrogen atom, alkyl group, aryl group, heterocyclic group and the like), COOH and the like may be functional groups which directly react with $G_1$ (here OH, SH, $NHR_4$, —COOH may be simultaneously preserved by the formation of these groups by hydrolytic decomposition by means of alkali and the like), or

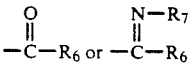

($R_6$ and $R_7$, which may be the same or different, each represents a hydrogen atom, alkyl group, alkenyl group, aryl group or heterocyclic group) may be functional groups which are able to react with $G_1$ in reacting with nucleophilic reagents such as hydroxyl ions or sulfite Further, it is preferred that the ring formed by $G_1$, $R_3$, $Z_1$ is a 5-membered one or a 6-membered one.

In the group represented by formula (a), the preferred groups are those represented by formulae (b) or (c).

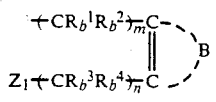

(b)

wherein $R_b^1$, $R_b^2$, $R_b^3$ and $R_b^4$ each represents a hydrogen atom, alkyl group (preferably with 1–12 carbons), alkenyl group (preferably with 2–12 carbons), aryl group (preferably with 6–12 carbons), and the like, and may be the same or different. B may contain one or more substituent groups, and comprises the atoms necessary to complete a 5-membered or 6-membered ring; m and n are 0 or 1, and (n+m) is 1 or 2.

Suitable 5-membered or 6-membered rings formed by B include, for example, a cyclohexene ring, a cycloheptene ring, a benzene ring, a naphthalene ring, a pyridine ring or a quinoline ring.

$Z_1$ is as defined in formula (a).

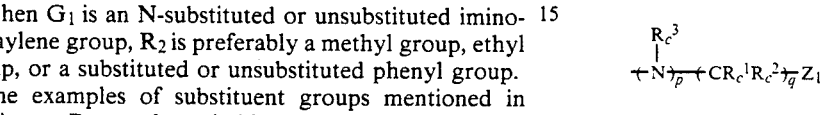

(c)

wherein $R_c^1$ and $R_c^2$ each represents a hydrogen atom, alkyl group, alkenyl group, aryl group or halogen atom, and the like, and may be the same or different.

$R_c^3$ represents a hydrogen atom, alkyl group, alkenyl group, or aryl group.

p represents 0 or 1; q represents 1, 2, 3 or 4.

$R_c^1$, $R_c^2$ and $R_c^3$ may bond together to form a ring, within the limits of a structure in which $Z_1$ may nucleophilically attack $G_1$.

$R_c^1$ and $R_c^2$ are preferably a hydrogen atom, halogen atom, or alkyl group; $R_c^3$ is preferably an alkyl or aryl group.

q preferably represents 1 to 3; when q is 1, p is 0 or 1; when q is 2, p is 0 or 1; when q is 3, p is 0 or 1; when q is 2 or 3, $CR_c^1$ and $R_c^2$ may be the same or may be the same or different.

$Z_1$ is synonymous with its definition in formula (a).

$A_1$ and $A_2$ each represents a hydrogen atom or, as noted above, one of $A_1$ and $A_2$ represents a hydrogen atom while the other represents an alkylsulfonyl group, an arylsulfonyl group or an acyl group, each of which may be substituted. In this latter case, $A_1$ or $A_2$ (which is not hydrogen) preferably is a 20 or fewer carbon alkylsulfonyl group, arylsulfonyl group (preferably phenylsulfonyl group or substituted phenylsulfonyl group having a total Hammett substituent group index of −0.5 or more), or a 20 or fewer carbon atom acyl group (preferably benzoyl group or substituted benzoyl group having a total Hammett substituent group index of −0.5 or more, or straight chain, branched or cyclic, substituted or unsubstituted aliphatic acyl group (suitable substituents include a halogen atom, ether, sulfonamido, carbonamido, hydroxy, carboxy, or sulfonic acid groups)).

Hydrogen atoms are most preferred as $A_1$ and $A_2$.

$R_1$ or $R_2$ in formula (II) may include ballast groups and polymer groups that are common in nondiffusible photographic additives. These ballast groups preferably possess 8 or more carbon atoms and are groups which are photographically comparatively inactive; for example, they can be chosen from alkyl, alkoxy, phenyl, alkylphenyl, phenoxy, alkylphenoxy and the like. Moreover, as polymer groups, those disclosed in JP-A-1-100530 may be used, for example.

Groups which have strong adhesion to the surface of silver halide grains may be included in $R_1$ or $R_2$ of formula (II). Examples of such adhesive groups include thiourea groups, heterocyclic thioamido groups, mercapto heterocyclic groups, triazole groups and the like, as disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.
Specific examples of compounds represented by formula (II) are shown below, but the present invention is not limited to these compounds.
II-1
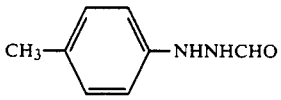
II-2
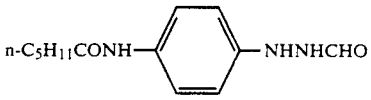
II-3
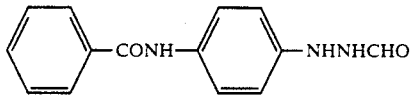
II-4
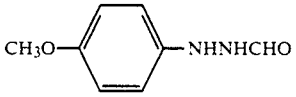
II-5
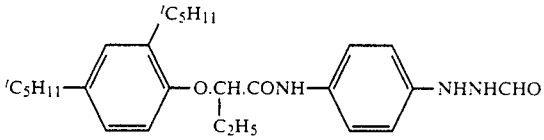
II-6
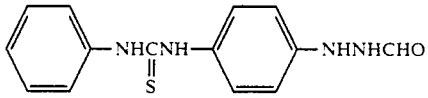
II-7
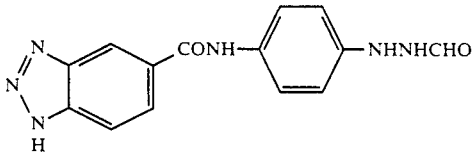
II-8
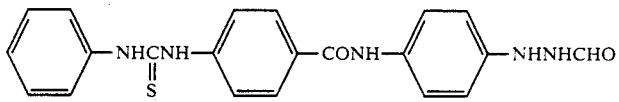
II-9
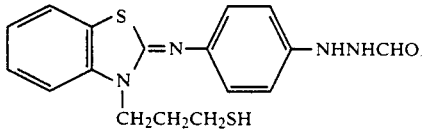
II-10
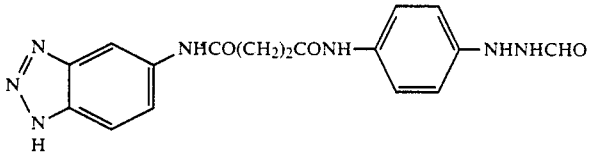
II-11
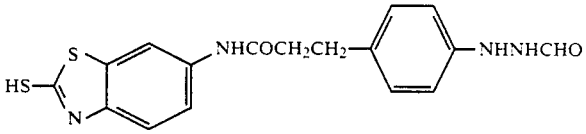

-continued
II-12
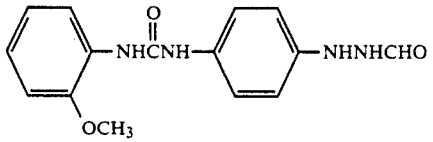
II-13
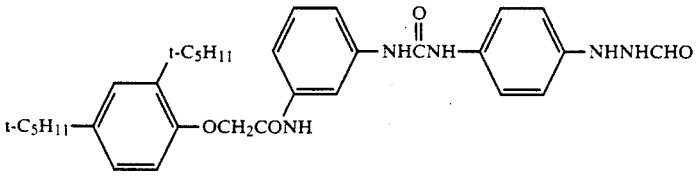
II-14
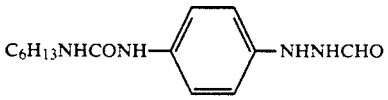
II-15
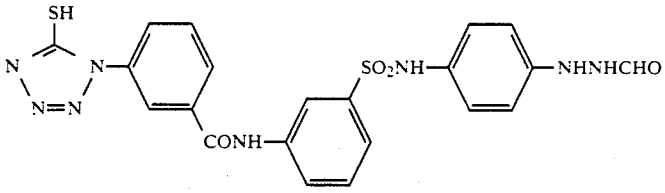
II-16
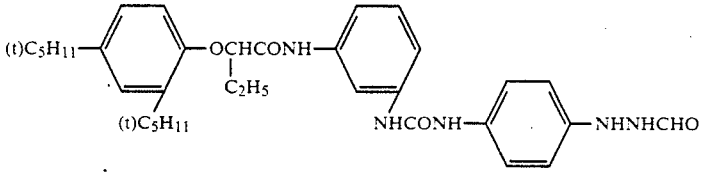
II-17
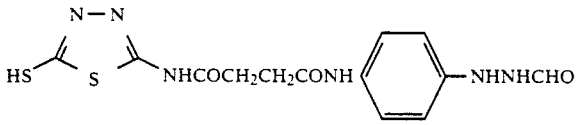
II-18
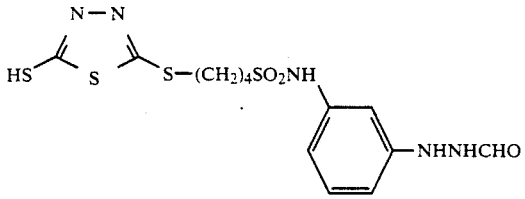
II-19
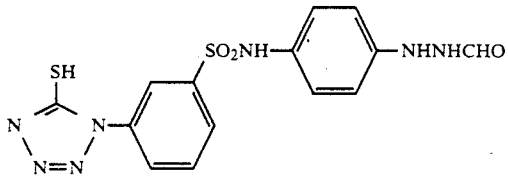
II-20
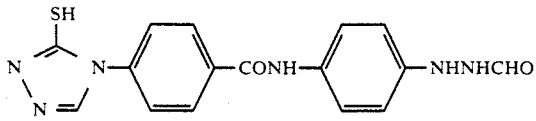

-continued
II-21
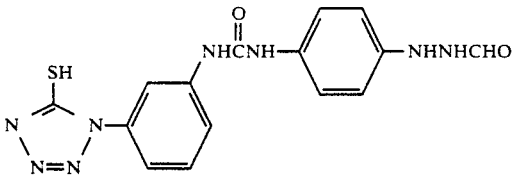
II-22
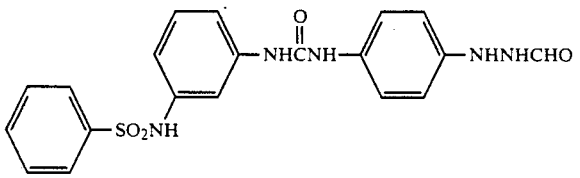
II-23
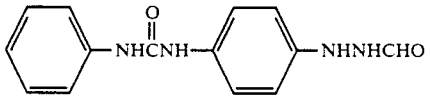
II-24
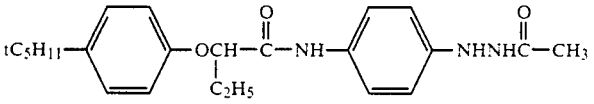
II-25
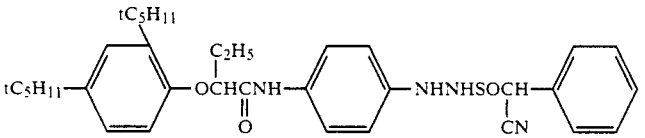
II-26
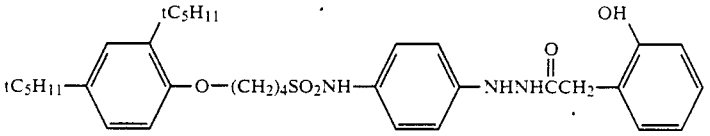
II-27
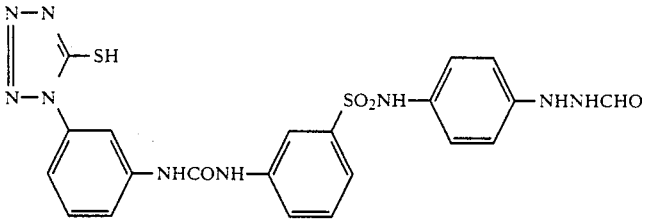
II-28
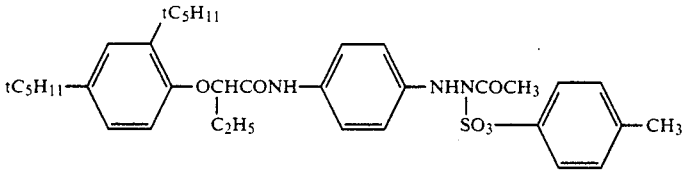
II-29
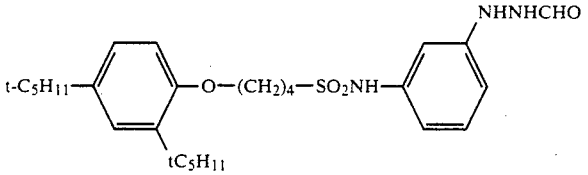
II-30
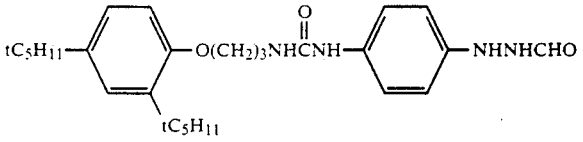

-continued
II-31
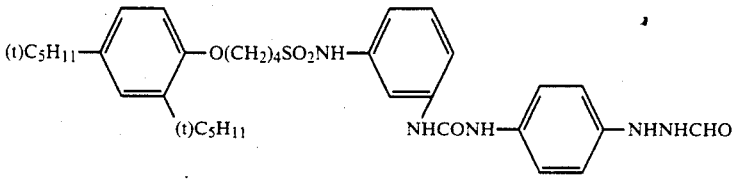
II-32
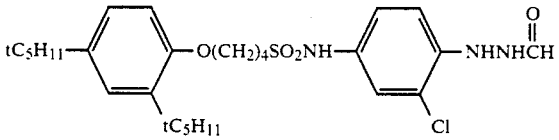
II-33
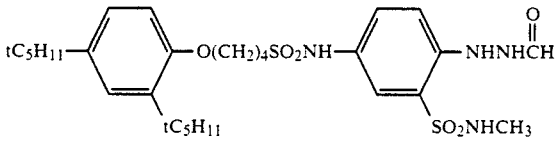
II-34
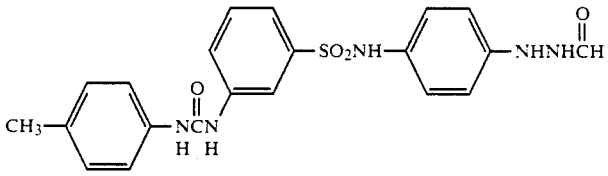
II-35
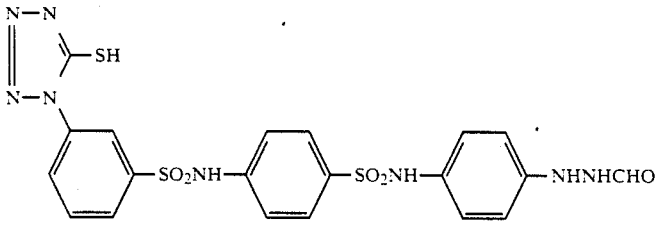
II-36
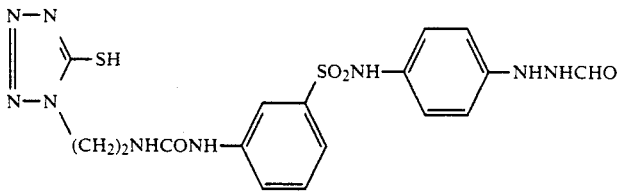
II-37
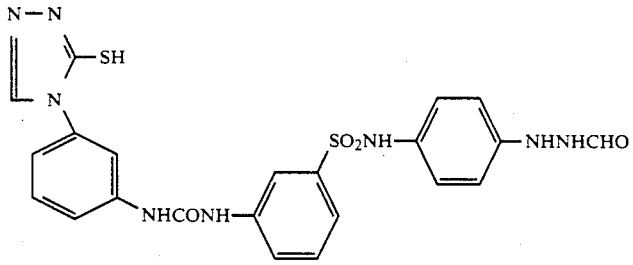
II-38
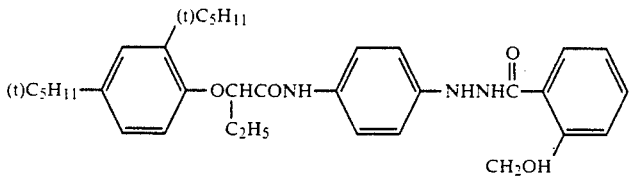

-continued
II-39
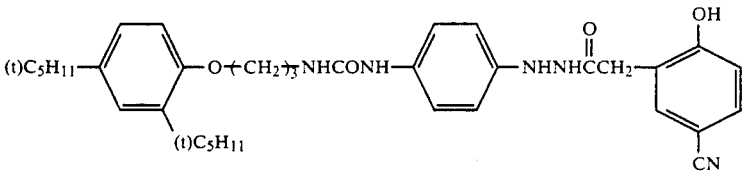
II-40
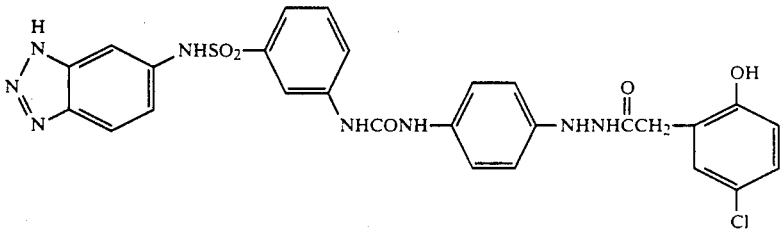
II-41
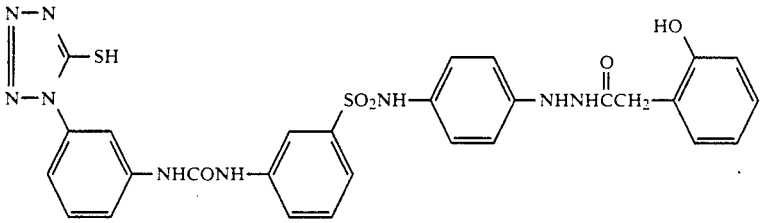
II-42
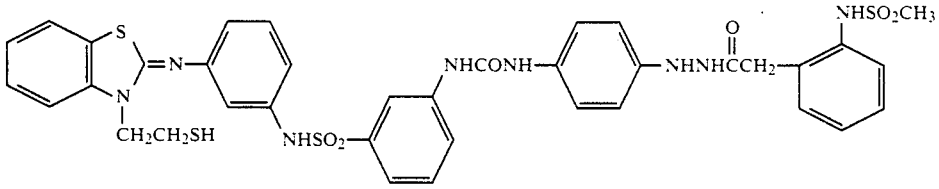
II-43
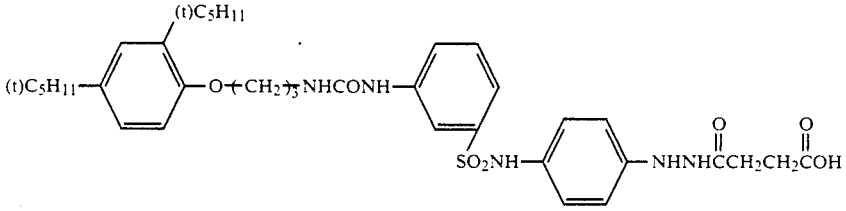
II-44
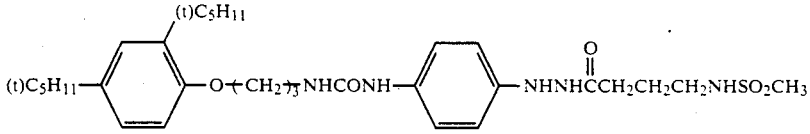
II-45
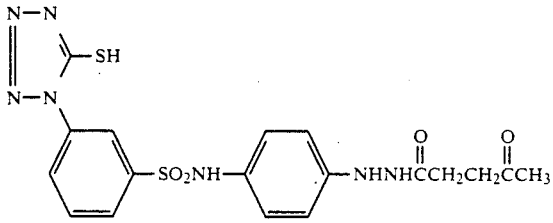
II-46
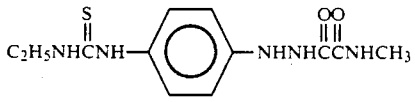

-continued
II-47
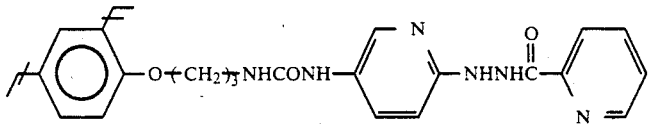
II-48
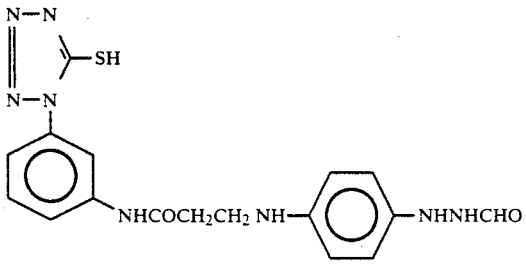
II-49
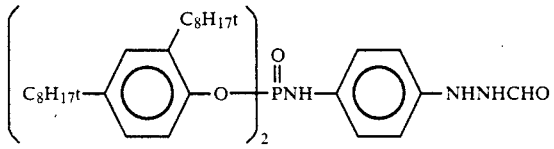
II-50
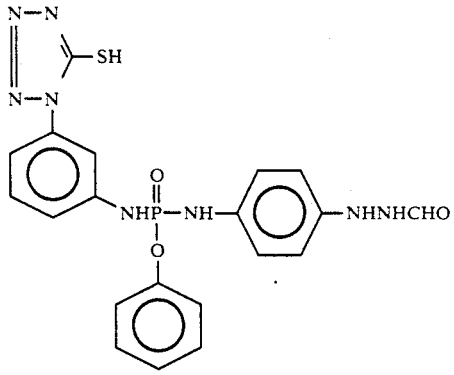
II-51
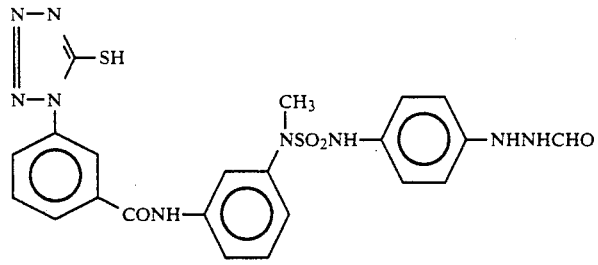
II-52
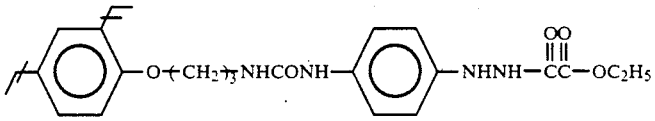
II-53
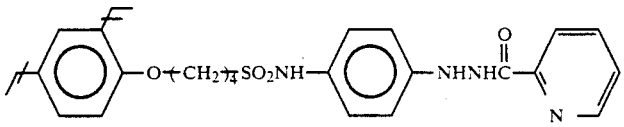

-continued
II-54
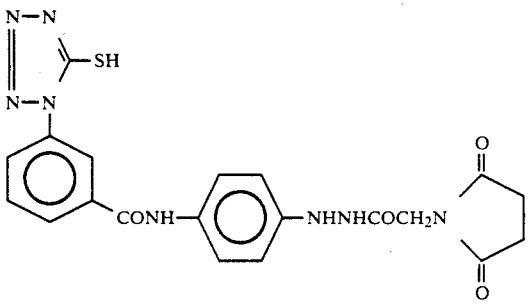
II-55
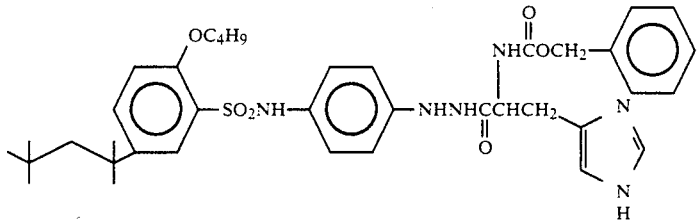
II-56
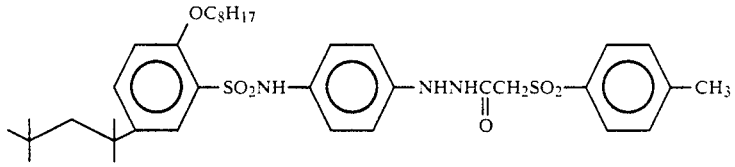
II-57
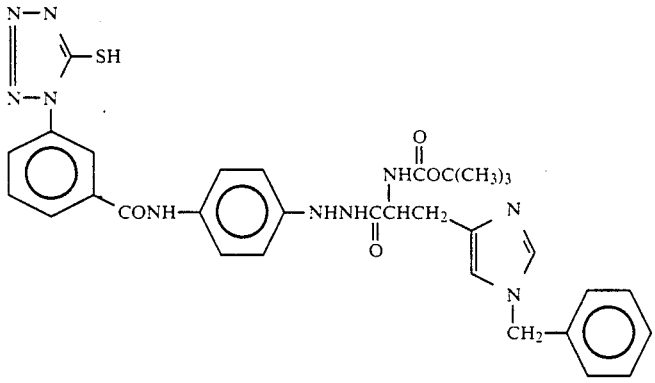
II-58
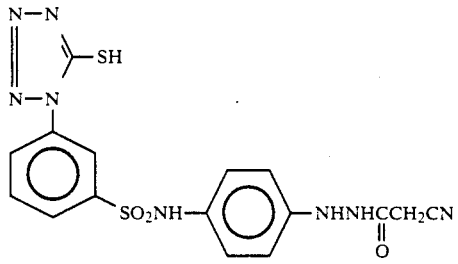
II-59
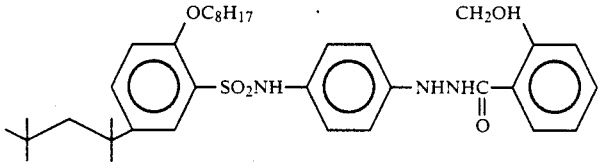
II-60
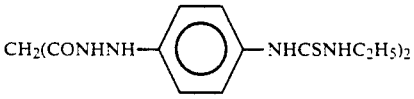

-continued

II-61

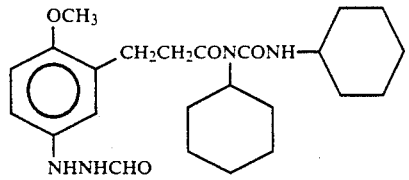

II-62

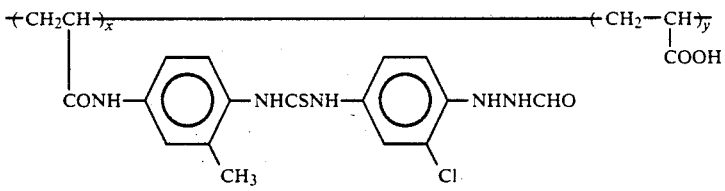

x:y = 97:3

As compounds represented by formula (II), other than the above examples, and other than those shown in *Research Disclosure,* No. 23516 (November, 1983, page 346) and the literature cited therein, those disclosed in the following may be used: U.S. Pat. Nos. 4,080,207, 4,269,929, 4,276,364, 4,278,748, 4,385,108, 4,459,347, 4,560,638, 4,478,928, British Patent 2,011,391B, JP-A-60-179734, JP-A-62-270948, JP-A-63-29751, JP-A-61-170733, JP-A-61-270744, JP-A-62-948, European Patent 217,310, JP-A-63-32538, JP-A-63-104047, JP-A-63-121838, JP-A-63-129337, JP-A-63-234245, JP-A-63-234246, JP-A-63-223744, JP-A-63-294552, JP-A-63-306448, JP-A-1-10233, and further U.S. Pat. 4,686,167, JP-A-62-178246, JP-A-63-234244, JP-A-63-306438, JP-A-1-100530, JP-A-1-105941, JP-A-1-105943, JP-A-1-90439, JP-A-1-276128, JP-A-1-283548, JP-A-1-280747, JP-A-1-283549, JP-A-1-285940.

The compound represented by formula (I) of the present invention may be used alone or in a combination of two or more. The compound(s) is present in a preferred amount of about $1\times10^{-5}$ to about $5\times10^{-2}$ mol per mol of silver halide, more preferably $2\times10^{-5}$ to $1\times10^{-2}$ mol per mol of silver halide.

The compound represented by formula (II) of the present invention may be used alone or in a combination of two or more. The amount of the compound(s) represented by formula (II) is preferably about $1\times10^{-6}$ to about $5\times10^{-2}$ mol per mol of silver halide, more preferably $1\times10^{-5}$ to $2\times10^{-2}$ mol per mol of silver halide. A suitable amount can be chosen to match the properties of the silver halide emulsion.

The compounds of formulae (I) and (II) used in the present invention can be incorporated into the material in solution, for example, in a suitable watermiscible organic solvent such as alcohols (methanol, ethanol, propanol, fluorinated alcohol), ketones (acetone, methyl ethyl ketone), dimethylformamide, dimethyl sulfoxide, methyl cellosolve and the like.

Further, by means of the already well-known emulsification dispersion methods, solutions in ethyl acetate, cyclohexanone, or similar assistant solvents, in dibutyl phthalate, tricresyl phosphate, glyceryl triacetate, diethyl phthalate, or similar oils, can be used to produce a mechanically emulsified dispersion. As a solids dispersion method, by known methods the redox powder can be dispersed in water, using a ball mill, colloid mill or ultrasonic waves.

The compounds of formulae (I) and (II) used in the present invention may be incorporated into either the photographic emulsion layer or hydrophilic colloid layer. Also, the compounds of formulae (I) and (II) may be incorporated together into the same layer or separately into different layers. The photographic emulsion layer may be a single layer or a multiple layer.

To add the compounds (I) and (II) used in the present invention to the photographic emulsion layer or hydrophilic colloid layer of the photosensitive material, the compounds having been first dissolved in water or a water-miscible organic solvent (if necessary, they may be dissolved with addition of alkali hydroxide or tertiary amine), the hydrophilic colloid solution (for example, silver halide emulsion, aqueous gelatin solution and the like) thus prepared may be added to the appropriate layer. The pH may be adjusted at this time if necessary by the addition of acid or alkali.

The compounds represented by formulae (I) and (II) used in the present invention can form negative images of high contrast by their use in combination with negative type emulsions. On the other hand, they can also be used in combination with internal latent image type silver halide emulsions. The use of the compounds represented by formulae (I) and (II) in combination with negative type emulsions, to form negative images of high contrast, is preferred.

The halogen composition of the silver halide used in the present invention may be any of silver bromide, silver iodobromide, silver chlorobromide or silver chloroiodobromide; a silver halide of bromine content 70 mol% or more is preferred. The iodine content is usually 10 mol% or less, preferably 5 mol% or less. The halogen composition of the interior and exterior of the silver halide grains of the present invention may be the same or different. The case in which the silver halide grains are of greater surface iodine content than in the interior and are photosensitized by sensitizing dyes is preferred.

There are no particular limitations on the crystal habit or form (e.g., regular crystals, twinned crystals, etc., may be used), but the cubic form is preferred from the standpoint of easy image nucleation by hydrazine derivatives.

Further, the grain size distribution is preferably monodispersed. A suitable monodispersed system is preferably a dispersion system with 95% of the grains within a ±60% number average grain diameter, and preferably falling within ±40% number average grain diameter.

There is no particular limitation on the average grain size of the silver halide, but it is preferably 0.05 to 0.5 μm. The average grain size is the numerical value represented by the average based on the projected area, and is the grain diameter when the grains are spherical or close to spherical, and in the case of cubic grains is the edge length as the respective grain size.

Various known methods can be carried out for the production of silver halides. For example, the neutral, acid, ammonia, sequential mixing, reverse mixing, and double jet (including controlled double jet) and the like methods, as disclosed in T. H. James, *The Theory of the Photographic Process,* 4th Ed., Macmillan (1977), pp. 88 to 104, can be utilized. Further, the method disclosed in JP-A-59-152438 can be utilized.

The grain size, grain form, distribution, etc., can be controlled, as needed, by the use of silver halide solvents such as thioethers, thioureas, and the like.

Cadmium salts, sulfites, lead salts, thallium salts, rhodium salts or their complexes, iridium salts or their complexes, and the like may be present in the process of formation or physical ripening of the silver halide grains in the silver halide emulsions used in the present invention.

The addition of $10^{-8}$ to $10^{-4}$ mol of rhodium salts per mol of Ag is preferable.

These silver halides may be chemically sensitized after the grain formation and desalting process, or may be utilized as they are, without chemical sensitization.

Suitable chemical sensitizers for chemical sensitization include, either alone or in combination, sulfur sensitizers, for example, sodium thiosulfate, thiourea and the like; precious metal sensitizers, for example, gold sensitizers, specifically chloroauric acid salts, gold trichloride and the like, palladium sensitizers, specifically palladium chloride, chloropalladic acid salts and the like, platinum compounds, iridium compounds and the like; selenium sensitizers, for example, selenous acid, selenourea and the like; reducing sensitizers, for example, stannous chloride, diethylenetriamine and the like polyamines, sulfite salts, silver nitrate and the like chemical sensitizers.

Sensitizing dyes which can be used in the present invention include various known sensitizing dyes for photographic materials, for example, cyanine dyes, merocyanine dyes, complex cyanine dyes, complex merocyanine dyes, holopolar cyanine dyes, hemicyanine dyes, styryl dyes, and hemioxonol dyes. Particularly useful dyes are dyes belonging to the classes of cyanine dyes, merocyanine dyes, and complex merocyanine dyes. Any nucleus commonly utilized in cyanine dyes is suitable as the basic heterocyclic nucleus in these dyes. Namely, pyrroline, oxazoline, thiazoline, pyrrole, oxazole, thiazole, selenazole, imidazole, tetrazole, pyridine and the like nuclei; alicyclic hydrocarbon rings fused to these nuclei; and nuclei with aromatic hydrocarbons fused to these nuclei; namely, indolenine, benzoindolenine, naphthoxazole, benzothiazole, naphthothiazole, benzoselenazole, benzimidazole, quinoline and the like nuclei are suitable. These nuclei may be substituted on the carbon atoms.

In the merocyanine or complex merocyanine dyes, suitable nuclei include those possessing a ketomethylene structure, pyrazolin-5-one, thiohydantoin, 2-thiooxazolidine-2,4-dione, thiazolidine-2,4-dione, rhodanine, thiobarbituric acid and similar 5- or 6-membered heterocyclic nuclei.

Useful sensitizing dyes, for example, are those disclosed in German Patent 929,080, U.S. Pat. Nos. 2,231,658, 2,493,748, 2,503,776, 2,519,001, 2,912,329, 3,656,959, 3,672,897 and 3,694,217, British Patent 1,242,588, JP-B-44-14030, JP-A-53-137133 and JP-A-55-45015 and JP-A-62-235947.

These sensitizing dyes may also be used either alone or in combination; a combination of sensitizing dyes is frequently used, particularly for strong sensitization. Together with the sensitizing dyes, dyes which themselves have no spectral sensitizing action, or materials which substantially do not absorb visible light and show supersensitizing action may be contained in the emulsion.

Useful sensitizing dyes, combinations of dyes showing supersensitization, and materials showing supersensitization other than mentioned above are disclosed in *Research Disclosure,* Vol. 176, No. 17643 (December issue, 1978), page 23, IV, sections A–J.

In the present invention, photosensitizing dyes and the like can be added in any process for the manufacture of photographic emulsions, or can be added at any stage after manufacture of the emulsion up to just before coating. Examples of the former are during grain formation and the like, during physical ripening, and during chemical ripening.

The sensitizing dyes used in the present invention can be added to the silver halide emulsion as an aqueous solution or dissolved in a water-miscible solvent, for example, methanol, ethanol, propyl alcohol, methyl cellosolve, pyridine and the like.

The preferred quantity of sensitizing dye used in the present invention is suitably an addition of $10^{-6}$ to $10^{-1}$ mol per mol of silver, preferably $10^{-4}$ to $10^{-2}$ mol.

These photosensitizing dyes may be used alone, but they also may be used in combination. A combination of photosensitizing dyes is frequently used for a particularly strong color sensitization.

Various other compounds may be included in the photosensitive materials of the present invention, for example, to prevent fogging in the process of manufacture of the photosensitive materials, during storage or photographic processing, or to stabilize photographic performance. Namely, many compounds known as antifoggants or as stabilizers can be added, such as azoles, for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles and the like; mercaptopyrimidines; mercaptotriazines; for example, thioketo compounds such as oxazolinethione; azaindenes, for example, triazaindenes, tetraazaindenes (particularly 4-hydroxy-substituted(1,3-,3*a*,7)tetraazaindenes) pentaazaindenes and the like; benzenethiosulfonic acid, benzenesulfinic acid, benzenesulfonic acid amide, hydroquinone derivatives, and the like. Among these, nitroindazoles (for example, 5-nitroindazole) and hydroquinone derivatives (for example, hydroquinone, methylhydroquinone) are preferred. Further, except for benzotriazoles among these compounds, they may be included in processing solutions. The influence of benzotriazoles on the image quality varies according to whether they are present in the sensitive material or in the processing solution. When present in the processing solution, the image quality may become poor, but there is practically no influence on image quality when they are present in the sensitive material, and fogging is effectively controlled.

Inorganic or organic film hardeners may be included in the photographic emulsion layer or in other hydrophilic layers, in the photographic materials of the present invention. For examples, active vinyl compounds (1,3,5-triacryloyl-hexahydro-s-triazine, 1,3-vinylsulfonyl-2-propanol and the like), active halogen compounds (2,4-dichloro-6-hydroxy-s-triazine and the like), mucohalogenic acids and the like may be used alone or in combination. Among others, the active vinyl materials disclosed in JP-A-53-41221, JP-A-53-57257, JP-A-59-162546 and JP-A-60-80846, and the active halogen materials disclosed in U.S. Pat. No. 3,325,287 are preferred.

The photographic emulsion layer of the present invention or other hydrophilic colloid layers may contain coating assistants, materials for static electricity prevention, slip improvement, emulsion dispersion, adhesion prevention and improvement of photographic characteristics (for example, development acceleration, contrast improvement, sensitization) and materials suitable for other various objects as would be understood by one of ordinary skill in the art, and may also contain various surfactants.

In particular, preferred surfactants for use in the present invention are the polyalkylene oxides of molecular weight 600 or more disclosed in JP-B-58-9412.

In the present invention, when antistatic agents are used, fluorine-containing surfactants (for example, those disclosed in U.S. Pat. No. 4,201,586, JP-A-60-80849) are particularly preferred.

For the purpose of improving dimensional stability, etc., in the photographic materials used in the present invention, dispersion of polymers which are water-soluble or of low solubility can be included. For example, polymer of alkyl (meth)acrylate, alkoxyalkyl (meth)acrylate, glycidyl (meth)acrylate, and the like, alone or in combination, or their combination with acrylic acid or methacrylic acid and similar monomers can be used.

Hydroquinone derivatives (known as DIR hydroquinone), which release development inhibitors corresponding to the density of the image when developed, may be included in hydrophilic colloid layers other than the photographic emulsion layer of the photographic materials of the present invention.

Compounds possessing acid groups are preferably included in the photographic emulsion layer and other layers of the photographic materials of the present invention. Suitable compounds possessing acid groups include salicylic acid, acetic acid, ascorbic acid and similar organic acids, and polymers or copolymers possessing acid monomer repeating units such as acrylic acid, maleic acid and phthalic acid. Reference can be made to JP-A-61-228437, JP-A-62-25745 and JP-A-62-55642 in relation to these compounds. Particularly preferred among these compounds are ascorbic acid as a low molecular weight compound and aqueous dispersion lattices of copolymers consisting of acid monomers such as acrylic acid and crosslinking monomers possessing 2 or more unsaturated groups such as divinylbenzene, as high molecular weight compounds.

Suitable binders or protective colloids used in the photosensitive materials include primarily gelatin, but other than gelatin, hydrophilic synthetic macromolecules are also useful. For example, lime-processed gelatin, acid-processed gelatin, gelatin derivatives and the like can be used as gelatin, specifically as disclosed in *Research Disclosure*, Vol. 176, No. 17643 (December, 1978), Section IX.

Other than the silver halide emulsion layer, the photosensitive materials of the present invention may comprise surface protective layers, interlayers, filter layers, antihalation layers, and other hydrophilic colloid layers.

Further, a backing layer (hereinafter termed as "back layer") can be disposed on the photosensitive materials used in the present invention for the purposes of discrimination between front and back, prevention of curling, antihalation and the like. It is particularly preferred, from the standpoint of adhesion resistance, to include in the back layer used in the present invention a matting material of comparatively large particle size. The preferred particle size is 1.0 μm to 10 μm; particularly preferred is 2.0 μm to 5.0 μm.

Further, there can be used as matting agents polymethyl methacrylate homopolymer, copolymers of methyl methacrylate and methacrylic acid, and magnesium oxide; and as lubricants, the silicone compounds disclosed in U.S. Pat. Nos. 3,489,576 and 4,047,958, colloidal silica as disclosed in JP-A-56-23139. Also, paraffin wax, higher fatty acid esters, starch and the like can be used as matting agents.

Further, as plasticizers, trimethylolpropane, pentanediol, butanediol, ethylene glycol, glycerin and the like polyols can be used in the hydrophilic colloid layers.

The impregnating development solutions or the highly alkaline (close to pH 13) developing solutions disclosed in U.S. Pat. No. 2,419,975 are not necessary to obtain highly sensitive photographic properties by supercontrast using the silver halide photographic materials of the present invention, and stable developing solutions can be used.

Namely, a developing solution of pH 11.2 or less and containing 0.20 mol/liter or more of sulfite ion as a preservative is preferred for developing the silver halide photographic materials of the present invention. Furthermore, the pH of the developing solution is preferably 11.0 to 9.5.

If the pH of developing solution is 11.2 or more, it is easily changed by $CO_2$ in the air; further the developing solution also easily oxidizes and becomes colored. Below pH 9.5, contrast becomes poor, and vivid image quality is not obtained.

There are no special limitations on the developing agents which may be used in the developing solutions of the present invention, but from the viewpoint of obtaining good dot quality, it is preferred that they include hydroxybenzenes. Furthermore, from the viewpoint of developing capacity, a combination of dihydroxybenzenes and 1-phenyl-3-pyrazolidones, or a combination of dihydroxybenzenes and p-aminophenols, is preferred.

The dihydroxybenzene developing agents used in the present invention include hydroquinone, chlorohydroquinone, isopropylhydroquinone, methylhydroquinone and the like; hydroquinone is particularly preferred.

The 1-phenyl-3-pyrazolidone or its derivatives used as developing agents in the present invention include 1-phenyl-3-pyrazolidone, 1-phenyl-4,4-dimethyl-3-pyrazolidone, 1-phenyl-4-methyl-4-hydroxymethyl-3-pyrazolidone and the like.

The p-aminophenol type developing agents used in the present invention include N-methyl-p-aminophenol, p-aminophenol, N-(β-hydroxyethyl)-p-aminophenol, N-(4-hydroxyphenyl)glycine and the like; among these, N-methyl-p-aminophenol is preferred.

It is preferred to use an amount of 0.05 mol/liter to 0.8 mol/liter of the developing agent. Further, when a combination of dihydroxybenzenes and 1-phenyl-3-pyrazolidones or p-aminophenols is used, it is preferred to use an amount of 0.05 mol/liter to 0.5 mol/liter of the former and 0.06 mol/liter or less of the latter.

The sulfite preservatives used in the present invention include sodium sulfite, potassium sulfite, lithium sulfite, ammonium sulfite, sodium bisulfite, potassium metabisulfite, sodium formaldehyde-bisulfite, and the like. An amount of sulfite of 0.20 mol/liter or more, particularly 0.3 mol/liter or more is used; when too much sulfite is added, this gives rise to sediment and contamination of the developing solution, so that an upper limit of 1.2 mol/liter is desirable.

Commonly employed water-soluble inorganic alkali metal salts (for example, sodium hydroxide, sodium carbonate) can be used as alkaline agents to set the pH of the developing solution.

Suitable buffers in the developing solutions of the present invention include boric acid as disclosed in JP-A-62-186259, sugars as disclosed in JP-A-60-93433 (for example, saccharose), oximes (for example, acetoxime), phenols (for example, 5-sulfosalicylic acid), triphosphates (for example, the potassium salt, sodium salt of triphosphates) and the like; it is preferred to use boric acid.

About 0.1 mol/liter or more, particularly 0.2 mol/liter to 1 mol/liter with respect to the developing solution, of buffer (preferably having an acid dissociation constant of $1\times10^{-11}$ to $3\times10^{-13}$) can be added. The amount of silver or the degree of blackening of the developed photosensitive materials is unaffected by the addition of these compounds, and it is possible to reliably obtain the supercontrasting and sensitivity increase effects due to hydrazines when an automatic developing machine is used. Moreover, the acid dissociation constant as used herein means compounds having a first, second or third constant of $1\times10^{31\ 11}$ to $3\times10^{-13}$.

Apart from the above constituents, suitable additives include pH adjusting compounds such as potassium hydroxide and sodium carbonate; development control agents such as sodium bromide and potassium bromide; organic solvents such as ethylene glycol, diethylene glycol, triethylene glycol, and dimethylformamide; development accelerators such as diethanolamine, triethanolamine and the like alkanolamines, and imidazoles and their derivatives; antifoggants or black pepper prevention agents such as 1-phenyl-5-mercaptotetrazole and the like mercapto type compounds, 5-nitroindazole and the like indazole type compounds, and benzotriazole type compounds; furthermore, toners, external surfactants, antifoaming agents, water softeners, film hardeners and the like may be included as needed.

The development is preferably carried out at about 20° C. to about 50° C. for about 10 seconds to about 1 minute.

Sodium thiosulfate, ammonium thiosulfate and the like thiosulfates are particularly useful as fixing agents; ammonium thiosulfate is particularly preferred from the viewpoint of fixing speed. The amount of fixing agents utilized can be varied as required, and is generally about 0.1 to about 5 mol/liter.

Acidic hardening agents used in the fixing solutions in the present invention include water-soluble aluminum salts, chromium salts and trivalent iron salts, with ethylenediaminetetraacetic acid as an acidifying agent. The preferred compounds are water-soluble aluminum salts, for example, aluminum chloride, aluminum sulfate, potassium alum and the like. The amount added is preferably 0.01 mol to 0.2 mol/liter or even more preferably 0.03 to 0.08 mol/liter.

Suitable dibasic acids which may be added to the fixing solution include tartaric acid or its derivatives, and citric acid and its derivatives, which can be used alone or in combination of two or more. About 0.005 mol or more of these compounds per liter of fixing solution is effective, and particularly 0.01 mol/liter to 0.03 mol/liter is particularly effective.

Specific tartaric acids which may be used are tartaric acid, potassium tartrate, sodium tartrate, sodium hydrogen tartrate, potassium sodium tartrate, ammonium tartrate, ammonium potassium tartrate, aluminum potassium tartrate, antimonyl potassium tartrate, antimonyl sodium tartrate, lithium hydrogen tartrate, lithium tartrate, magnesium hydrogen tartrate, potassium borotartrate, lithium potassium tartrate and the like.

Examples of citric acid and its derivatives which are effective in the present invention are citric acid, sodium citrate, potassium citrate, lithium citrate, ammonium citrate and the like.

Preservatives (for example, sulfites, bisulfites), pH buffers (for example, acetic acid, boric acid), pH regulating agents (for example, sulfuric acid), and chelating agents can be optionally included in the fixing solution. The pH buffers are used in an amount of 10 to 40 g/liter, more preferably about 18 to 25 g/liter, since the pH of the fixing solution is generally high.

The fixing temperature and time are similar to the case of development; 10 seconds to 1 minute at about 20° C. to about 50° C. is preferred.

The present invention is described in more detail below by means of specific examples, but the present invention is in no way limited by these examples. Unless otherwise indicated, all parts, percents, ratios and the like are by weight.

EXAMPLE 1

Preparation of Photosensitive Emulsion

A monodispersed emulsion of cubic grains of average grain size 0.28 μm, average silver iodide content 0.3 mol%, was prepared by adding to an aqueous gelatin solution kept at 50° C. and in the presence of $4^{10-7}$ mol per mol silver of iridium(III) potassium hexachloride and ammonia, aqueous silver nitrate solution and aqueous potassium bromide-potassium iodide solution simultaneously, over the course of 60 minutes, while keeping the pAg at 7.8. Desalting of this emulsion was performed by a flocculation method, after which 40 g of inert gelatin per mol silver were added, then while maintaining a temperature of 50° C., 5,5,-dichloro-9-ethyl-3,3,-bis(3sulfopropyl)oxacarbocyanine as sensitizing dye and $10^{-3}$ mol KI solution per mol of silver were added, and the temperature was reduced after 15 minutes.

Coating of Photosensitive-Emulsion Layer

This emulsion was redissolved, and at 40° C., as shown in Table 1, the compounds of formula (I) and the compounds of formula (II) were added thereto. Furthermore, 5-methylbenzotriazole, 4-hydroxy-1,3,3*a*7-tetrazaindene, Compounds (a) and (b) mentioned below, and 30 wt % of polyethylene glycol with respect to the gelatin were added; immediately, or after 6 hours' stirring, Compound (c) mentioned below was added as a gelatin hardener, and coating was performed in an amount of 3.8 g/m$^2$ as silver on a polyethylene terephthalate film (150 μm) having an undercoat (0.5 μm) of vinylidene chloride copolymer.

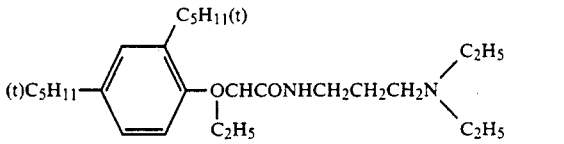

(a)

3.5 mg/m²

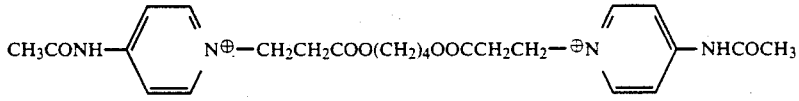

(b)

2Cl⊖ 15.0 mg/m²

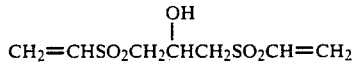

(c)

2.0 wt % with respect to gelatin

Coating of Protective Layer

A protective layer was coated on the emulsion layer, comprising 1.5 g/m² of gelatin, polymethyl metharylate particles (average particle diameter: 2.5 μm), fine AgCl grains (0.08 μm), prepared by the method mentioned below, in an amount of silver of 0.3 g/m², and using the following surfactants.

| Surfactants | |
|---|---|
| 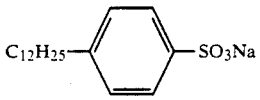 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2NCH_2COOK$<br>\|<br>$C_3H_7$ | 2.5 mg/m² |

Evaluation of Performance (1) Dot Quality

After exposure of the samples to 3,200° K tungsten light through an optical wedge and contact screen (Fuji Film 150 L chain dot type), they were developed in the following developing solution at 34° C. for 30 seconds, fixed, washed and dried.

The results of measurements of dot quality and dot gradation of the samples obtained are shown in Table 1.

Dot gradation is represented by the following formula:

* Dot gradation = [Exposure amount Δ log*E* (log*E* 95%) for a 95% dot area coefficient] − [Exposure amount (log*E* 5%) for a 5% dot area coefficient]

Dot quality was evaluated visually in five grades. The five evaluation grades represented dot quality from "5" being best to "1" being worst. As a photoengraving dot original plate, "5" and "4" are considered to be of a quality at which practical use is possible, "3" is at the limiting level for practical use, "2" and "1" cannot be used in practice.

The results are shown in Table 1:

| Developing Solution | |
|---|---|
| Hydroquinone | 50.0 g |
| N-Methyl-p-aminophenol | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)-benzenesulfonate | 0.2 g |
| N-n-Butyldiethanolamine | 15.0 g |
| Sodium Toluenesulfonate | 8.0 g |
| Water added to make | 1.0 liter |
| Adjusted to pH = 11.5 (potassium hydroxide added) | pH 11.5 |

Comparative samples were prepared as above, but using the following Comparison Compound-a to Comparison Compound-d in place of compounds of formulae (I) and (II) as shown in Table 1:

Comparison Compound-a

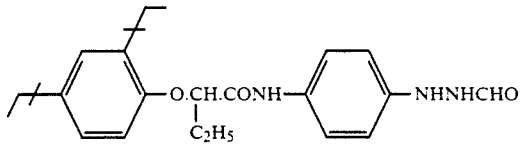

Comparison Compound-b

-continued

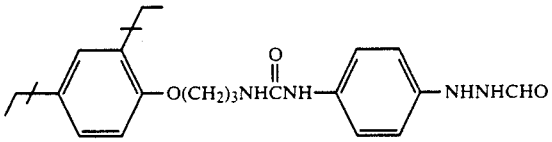

Comparison Compound-c

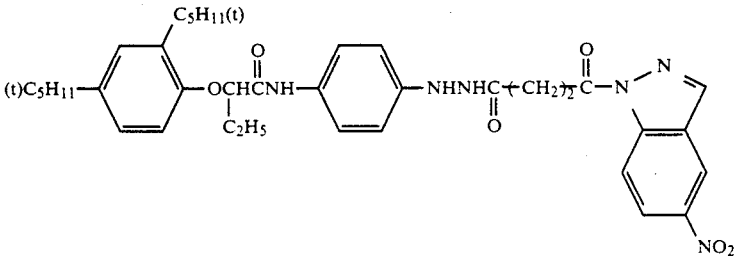

Comparison Compound-d

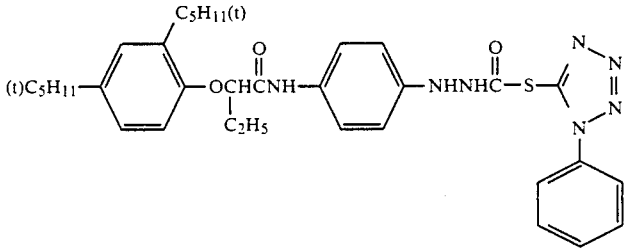

TABLE 1

| Sample No. | Compound of Formula (I) Type | Compound of Formula (I) Amount Added (mol/mol Ag) | Compound of Formula (II) Type | Compound of Formula (II) Amount Added (mol/mol Ag) | Coating Directly after Addition: Dot Gradation (Δ log E) | Coating Directly after Addition: Dot Quality | Coating 6 Hours after Addition: Dot Gradation (Δ log E) | Coating 6 Hours after Addition: Dot Quality |
|---|---|---|---|---|---|---|---|---|
| Comparison | | | | | | | | |
| Sample 1 | — | — | Comparison Compound-a | $2.0 \times 10^{-3}$ | 1.23 | 3 | 1.22 | 3 |
| Sample 2 | — | — | Compairson Compound-b | $7.0 \times 10^{-4}$ | 1.21 | 3 | 1.20 | 3 |
| Sample 3 | Comparison Compound-c | $5.7 \times 10^{-4}$ | Comparison Compound-a | $2.0 \times 10^{-3}$ | 1.33 | 4 | 1.26 | 3 |
| Sample 4 | Comparison Compound-d | $5.7 \times 10^{-4}$ | Comparison Compound-a | $2.0 \times 10^{-3}$ | 1.21 | 2 | 1.20 | 2 |
| Sample 5 | Comparison Compound-c | $5.7 \times 10^{-4}$ | Comparison Compound-b | $7.0 \times 10^{-4}$ | 1.32 | 4 | 1.24 | 3 |
| Sample 6 | Comparison Compound-d | $5.7 \times 10^{-4}$ | Comparison Compound-b | $7.0 \times 10^{-4}$ | 1.19 | 2 | 1.18 | 2 |
| Invention | | | | | | | | |
| Sample 1 | I-3 | $5.7 \times 10^{-4}$ | II-5 | $2.0 \times 10^{-3}$ | 1.40 | 4 | 1.39 | 4 |
| Sample 2 | " | $4.0 \times 10^{-3}$ | " | " | 1.43 | 4 | 1.41 | 4 |
| Sample 3 | " | $5.7 \times 10^{-4}$ | II-30 | $7.0 \times 10^{-4}$ | 1.38 | 4 | 1.37 | 4 |
| Sample 4 | " | $4.0 \times 10^{-3}$ | " | " | 1.39 | 4 | 1.37 | 4 |
| Sample 5 | I-7 | $5.7 \times 10^{-4}$ | II-5 | $2.0 \times 10^{-3}$ | 1.39 | 4 | 1.38 | 4 |
| Sample 6 | " | " | II-30 | $7.0 \times 10^{-4}$ | 1.38 | 4 | 1.37 | 4 |
| Sample 7 | " | " | II-38 | " | 1.37 | 5 | 1.37 | 5 |
| Sample 8 | I-8 | " | II-34 | " | 1.37 | 5 | 1.36 | 5 |
| Sample 9 | I-9 | " | II-30 | " | 1.39 | 4 | 1.37 | 4 |
| Sample 10 | I-31 | " | II-52 | " | 1.39 | 4 | 1.38 | 4 |
| Sample 11 | I-38 | " | II-49 | " | 1.37 | 5 | 1.36 | 5 |
| Sample 12 | I-40 | " | II-27 | $3.5 \times 10^{-4}$ | 1.39 | 5 | 1.38 | 5 |
| Sample 13 | I-41 | " | II-59 | $7.0 \times 10^{-4}$ | 1.38 | 5 | 1.36 | 5 |
| Sample 14 | I-45 | " | " | " | 1.38 | 5 | 1.37 | 5 |

The results in Table 1 show that dot gradation is markedly wider for the samples of the present invention as compared with the comparison samples; moreover, dot quality improved. Furthermore, in the case where Comparison Compound-c and Comparison Compound-d were added (Comparison Samples 3 to 6), the effect of widening dot gradation decreased with the time between addition and coating, in contrast to the samples of the present invention (Samples 1 to 14); whether addition was directly before coating or 6 hours before coating, these exhibited both good dot gradation and good dot quality. The compounds of the present invention, when added to photographic materials, give rise to excellent stability over time.

EXAMPLE 2

The samples of Example 1, after exposure in a manner similar to Example 1, were processed in an automatic developing machine for photoengraving use, FG660F (Fuji Photo Film Co., Ltd.), replenishing the developing solution used in Example 1, and under the three conditions as set out below, development for 30 seconds at 34° C., fixing, washing and drying were performed.

(A) Developing was immediately performed after the temperature of the charged developing solution in the automatic developing machine reached 34° C. (i.e., development by fresh solution).

(B) Developing was performed in solution which had been left alone for 4 days after charging of the developing solution in the developing machine (i.e., development by air-fatigued solution).

(C) After charging of the developing solution in the developing machine, a Fuji Film Grandex GA-100 film of size 50.8 cm×61.0 cm was exposed for development of 50% of its area; 200 processings were performed in 1 day, and developing was repeated during 5 days with the solution. 100 cc of the developing solution were replenished per one processing.

The photographic properties obtained are shown in Table 2. From the viewpoint of process running stability it is desirable for there to be no difference between the photographs obtained by (B) or (C) and the photographs of (A). The results of Table 2 show that the process running stability was unexpectedly superior when the compounds of the present invention were used.

TABLE 2

| | Sample No. | Process Running Stability: Air-Fatigued Solution ($\Delta S_{B-A}$*) | Process Running Stability: Solution Fatigued by Mass Processing ($\Delta S_{C-A}$*) |
|---|---|---|---|
| | Comparison | | |
| 1 | Sample 1 | +0.23 | −0.39 |
| 2 | Sample 2 | +0.16 | −0.26 |
| 3 | Sample 3 | +0.19 | −0.24 |
| 4 | Sample 4 | +0.25 | −0.40 |
| 5 | Sample 5 | +0.14 | −0.42 |

TABLE 2-continued

| | Sample No. | Process Running Stability: Air-Fatigued Solution ($\Delta S_{B-A}$*) | Process Running Stability: Solution Fatigued by Mass Processing ($\Delta S_{C-A}$*) |
|---|---|---|---|
| 6 | Sample 6 | +0.19 | −0.29 |
| | Invention | | |
| 7 | Sample 1 | +0.12 | −0.10 |
| 8 | Sample 2 | +0.13 | −0.12 |
| 9 | Sample 3 | +0.11 | −0.10 |
| 10 | Sample 4 | +0.10 | −0.11 |
| 11 | Sample 5 | +0.13 | −0.14 |
| 12 | Sample 6 | +0.09 | −0.10 |
| 13 | Sample 7 | +0.11 | −0.12 |
| 14 | Sample 8 | +0.08 | −0.11 |
| 15 | Sample 9 | +0.10 | −0.09 |
| 16 | Sample 10 | +0.09 | −0.09 |
| 17 | Sample 11 | +0.08 | −0.10 |
| 18 | Sample 12 | +0.07 | −0.08 |
| 19 | Sample 13 | +0.08 | −0.08 |
| 20 | Sample 14 | +0.08 | −0.09 |

*$\Delta S_{B-A}$: Difference between sensitivity when developed with air-fatigued solution ($S_B$) and sensitivity when developed with fresh solution ($S_A$)
$\Delta S_{C-A}$: Difference between sensitivity when developed with solution fatigued by mass processing ($S_C$) and sensitivity when developed with fresh solution ($S_A$)

EXAMPLE 3

An emulsion was prepared by simultaneously mixing with an aqueous gelatin solution kept at 50° C., and in the presence of $5.0\times10^{-6}$ mol per mol silver of $(NH_4)_3RhCl_6$, aqueous silver nitrate solution and aqueous sodium chloride solution; after eliminating soluble salts in the manner known in the art, 2-methyl-4-hydroxy1,3,3*a*,7-tetraazaindene was added as a stabilizer. This emulsion of cubic grains had an average grain size of 0.15 μm, and was a monodispersed emulsion.

To this emulsion there were added, as shown in Table 3, compounds of formula (I) of the present invention and compounds of formula (II) of the present invention, a polyethyl acrylate latex was added at 30 wt% solids with respect to the gelatin, 1,3-vinylsulfonyl-2-propanol was added as a hardener, and the emulsion was coated onto a polyester support at 3.8 g/m² of silver. The amount of gelatin was 1.8 g/m². Onto this layer was coated and dried a protective layer comprising 1.5 g/m² of gelatin, 0.3 g/m² of polymethyl methacrylate particles (average particle diameter: 2.5 μm), and furthermore, as a coating assistant, the following surfactants, stabilizer, and ultraviolet absorber.

| | |
|---|---|
| Surfactant | |
| 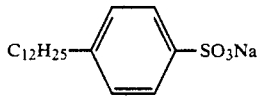 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2N(C_3H_7)CH_2COOK$ | 2.5 mg/m² |
| Stabilizer | |
| Thioctic Acid | 2.1 mg/m² |
| Ultraviolet Absorber | |

-continued

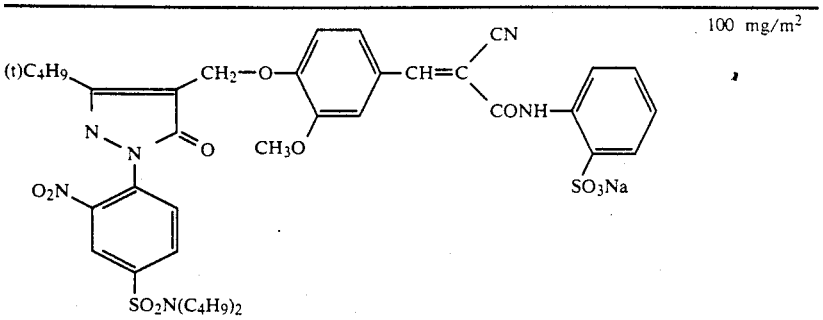

This sample was exposed in a Dai-Nippon Daylight Printer p-607, through the originals as shown in FIG. 1, and developed for 20 seconds at 38° C., fixed, washed, and dried, after which evaluation was performed of the white-on-black character images.

A white-on-black character image quality 5 means, using the original image as shown in FIG. 1, that when the proper exposure was given so that 50% dot area became 50% dot area on the reversal photosensitive material, for a 30 μm width of character, the picture quality of the reproduced image was very good. On the other hand, a white-on-black character image quality 1 means that when similarly properly exposed, only a character of 150 μm width or more could be reproduced, that is to say, the quality of the reproduced image was not good; ranks 4 to 2 were established by the functional evaluation between 5 and 1. The minimum level for possible practical use is 3.

The results are shown in Table 3. The samples of the present invention gave excellent white-on-black character images.

EXAMPLE 4

The samples of Example 3, after exposure in a manner similar to Example 2, were processed in an automatic developing machine for photoengraving use, FG660F (Fuji Photo Film Co., Ltd.), charged with the developing solution used in Example 1, and under the three conditions as set out below, development for 30 seconds at 34° C., fixing, washing and drying were performed.

(A) Developing was immediately performed after the temperature of the charged developing solution in the automatic developing machine reached 34° C. (i.e., development by fresh solution).

(B) Developing was performed in solution which had been left alone for 4 days after charging of the developing solution in the developing machine (i.e., development by air-fatigued solution).

(C) After charging of the developing solution in the developing machine, a Fuji Film Grandex VU-100 film of size 50.8 cm×61.0 cm was exposed for development of 50% of its area; 200 processings were performed in 1 day, and developing was re-

TABLE 3

| | Compounds of Formula (I) | | Compounds of Formula (II) | | White-on-Black | Process Running Stability | |
|---|---|---|---|---|---|---|---|
| Sample No. | Type | Amount Added (mol/mol Ag) | Type | Amount Added (mol/mol Ag) | Character Image Quality | Air-Fatigued Solution ($\Delta S_{B-A}$*) | Solution Fatigued by Mass Processing ($\Delta S_{C-A}$*) |
| Comparison | | | | | | | |
| Sample 1 | — | — | Comparison Compound-a | $5.0 \times 10^{-3}$ | 2.5 | +0.17 | −0.25 |
| Sample 2 | — | — | Comparison Compound-b | $1.8 \times 10^{-3}$ | 3.0 | −0.09 | −0.16 |
| Sample 3 | Comparison Compound-c | $1.4 \times 10^{-3}$ | Comparison Compound-a | $5.0 \times 10^{-3}$ | 3.0 | +0.15 | −0.21 |
| Sample 4 | Comparison Compound-d | $1.4 \times 10^{-3}$ | Comparison Compound-a | $5.0 \times 10^{-3}$ | 2.5 | +0.20 | −0.29 |
| Sample 5 | Comparison Compound-c | $1.4 \times 10^{-3}$ | Comparison Compound-b | $1.8 \times 10^{-3}$ | 3.5 | +0.07 | −0.13 |
| Sample 6 | Comparison Compound-d | $1.4 \times 10^{-3}$ | Comparison Compound-b | $1.8 \times 10^{-3}$ | 3.0 | +0.13 | −0.20 |
| Invention | | | | | | | |
| Sample 1 | I-3 | $1.4 \times 10^{-3}$ | II-5 | $5.0 \times 10^{-3}$ | 4.0 | +0.04 | −0.09 |
| Sample 2 | " | $9.8 \times 10^{-3}$ | " | " | 4.0 | +0.04 | −0.08 |
| Sample 3 | " | $1.4 \times 10^{-3}$ | II-30 | $1.8 \times 10^{-3}$ | 4.0 | +0.04 | −0.07 |
| Sample 4 | " | $9.8 \times 10^{-3}$ | " | " | 4.0 | +0.04 | −0.07 |
| Sample 5 | I-7 | " | II-5 | $5.0 \times 10^{-3}$ | 4.0 | +0.04 | −0.10 |
| Sample 6 | " | " | II-30 | $1.8 \times 10^{-3}$ | 4.0 | +0.03 | −0.07 |
| Sample 7 | " | " | II-38 | " | 4.5 | +0.04 | −0.09 |
| Sample 8 | I-8 | " | II-34 | " | 4.5 | +0.03 | −0.07 |
| Sample 9 | I-9 | " | II-30 | " | 4.0 | +0.04 | −0.09 |
| Sample 10 | I-31 | " | II-52 | " | 4.0 | +0.03 | −0.08 |
| Sample 11 | I-38 | " | II-49 | " | 4.5 | +0.03 | −0.08 |
| Sample 12 | I-40 | " | II-27 | " | 4.5 | +0.03 | −0.07 |
| Sample 13 | I-41 | " | II-59 | " | 4.5 | +0.03 | −0.07 |
| Sample 14 | I-45 | " | II-59 | " | 4.5 | +0.03 | −0.07 |

peated during 5 days with the solution. 100 cc of the developing solution were replenished per one processing.

The results are shown in Table 3. From the viewpoint of process running stability, it is desirable for there to be no difference between the photographs obtained by (B) or (C) and the photographs of (A). The results of Table 3 show that the process running stability was unexpectedly superior using the compounds of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one compound represented by formula (I):

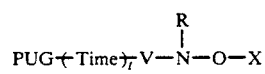

(I)

wherein X represents a hydrogen atom or a group which can become a hydrogen atom by hydrolytic action, Time represents a divalent connecting group, t represents 0 or 1, PUG represents a development inhibitor, V represents a carbonyl group,

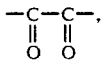

a sulfonyl group, a sulfoxy group,

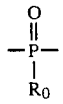

($R_0$ represents an alkoxy group or an aryloxy group), an iminomethylene group, a thiocarbonyl group or

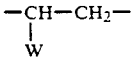

represents an electron attractive group), R represents a hydrogen atom, a substituted or unsubstituted aliphatic group, a substituted or unsubstituted aromatic group, or

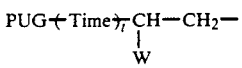

PUG, Time, t and W are as defined above); and at least one compound represented by formula (II):

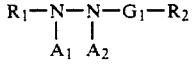

(II)

wherein $R_1$ represents a substituted or unsubstituted aliphatic group or a substituted or unsubstituted (aromatic group, $R_2$ represents a hydrogen atom, an alkyl group, an aryl group, an alkoxy group, an aryloxy group, an amino group, a hydrazino group, a carbamoyl group or an oxycarbonyl group, each of which may be substituted, $G_1$ represents a carbonyl group, a sulfonyl group, a sulfoxy group,

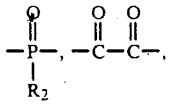

a thiocarbonyl group, or an iminomethylene group, $A_1$ and $A_2$ each represents a hydrogen atom, or one of $A_1$ and $A_2$ represents a hydrogen atom while the other represents a substituted or unsubstituted alkylsulfonyl group, a substituted or unsubstituted arylsulfonyl group, or a substituted or unsubstituted acyl group, said at least one compound of formula (I) and said at least one compound of formula (II) being present in the same layer or in different layers selected from a photographic emulsion layer and a hydrophilic colloid layer.

2. A silver halide photographic material according to claim 1, wherein said group which can become a hydrogen atom by hydrolytic action represented by X is a blocking group for photographic reagents.

3. A silver halide photographic material according to claim 1, wherein said divalent connecting group represented by Time is a group which releases PUG in a reaction of one or more stages from Time-PUG which has been released from an oxidation product of an oxidation reduction nucleus.

4. A silver halide photographic material according to claim 1, wherein said development inhibitor represented by PUG contains a hetero atom and is bonded via the hetero atom.

5. A silver halide photographic material according to claim 4, wherein said hetero atom-containing development inhibitor is selected from the group consisting of mercaptotetrazoles, mercaptotriazoles, mercaptoimidazoles, mercaptopyrimidines, mercaptobenzimidazoles, mercaptothiadiazoles, mercaptobenzothiazoles, mercaptobenzoxazoles, benzotriazoles, benzimidazoles, indazoles, tetrazoles, tetraazaindenes, and mercaptoaryls.

6. A silver halide photographic material according to claim 1, wherein said electron attractive group represented by W is a group which possesses a Hammett $\sigma_{para}$ value exceeding 0.3.

7. A silver halide photographic material according to claim 1, wherein said substituted or unsubstituted aliphatic group represented by R is a straight chain, branched r cyclic alkyl group, alkenyl group or alkynyl group.

8. A silver halide photographic material according to claim 1, wherein said substituted or unsubstituted aromatic group represented by R is a monocyclic or bicyclic aryl group or an unsaturated heterocyclic group.

9. A silver halide photographic material according to claim 1, wherein said V is a carbonyl group.

10. A silver halide photographic material according to claim 1, wherein said substituted or unsubstituted aliphatic group represented by $R_1$ contains 1 to 30 carbon atoms.

11. A silver halide photographic material according to claim 10, wherein said aliphatic group is a 1 to 20 carbon atom straight chain, branched or cyclic alkyl group.

12. A silver halide photographic material according to claim 1, wherein said substituted or unsubstituted aromatic group represented by $R_1$ is a monocyclic or bicyclic aryl group or an unsaturated heterocyclic group.

13. A silver halide photographic material according to claim 1, wherein said $G_1$ is a carbonyl group.

14. A silver halide photographic material according to claim 1, wherein both of said $A_1$ and $A_2$ are hydrogen atom.

15. A silver halide photographic material according to claim 1, wherein said at least one compound represented by formula (I) is present in an amount of from about $1\times10^{-5}$ to about $5\times10^{-2}$ mol per mol of silver halide.

16. A silver halide photographic material according to claim 15, wherein said amount is from $2\times10^{-5}$ to $1\times10^{-2}$ mol per mol of silver halide.

17. A silver halide photographic material according to claim 1, wherein said at least one compound represented by formula (II) is present in an amount of from about $1\times10^{-6}$ to about $5\times10^{-2}$ mol per mol of silver halide.

18. A silver halide photographic material according to claim 17, wherein said amount is from $1\times10^{-5}$ to $2\times10^{-2}$ mol per mol of silver halide.

* * * * *